US010056202B2

(12) United States Patent
Naka et al.

(10) Patent No.: US 10,056,202 B2
(45) Date of Patent: Aug. 21, 2018

(54) PUSH BUTTON SWITCH

(71) Applicant: OMRON Corporation, Kyoto-shi, Kyoto (JP)

(72) Inventors: Mamiko Naka, Okayama (JP); Kenshi Nagata, Kurayoshi (JP); Hiroaki Fujino, Setouchi (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/510,251

(22) PCT Filed: Nov. 30, 2015

(86) PCT No.: PCT/JP2015/083587
§ 371 (c)(1),
(2) Date: Mar. 10, 2017

(87) PCT Pub. No.: WO2016/098568
PCT Pub. Date: Jun. 23, 2016

(65) Prior Publication Data

US 2017/0287657 A1 Oct. 5, 2017

(30) Foreign Application Priority Data

Dec. 15, 2014 (JP) ..... 2014-253499

(51) Int. Cl.
*H01H 1/14* (2006.01)
*H01H 13/14* (2006.01)
(Continued)

(52) U.S. Cl.
CPC ..... *H01H 13/14* (2013.01); *H01H 13/06* (2013.01); *H01H 13/70* (2013.01); *H01H 2223/044* (2013.01); *H01H 2235/01* (2013.01)

(58) Field of Classification Search
CPC ..... H01H 13/14; H01H 13/06; H01H 13/70; H01H 2223/044; H01H 2235/01;
(Continued)

(56) References Cited

U.S. PATENT DOCUMENTS 2,713,092 A * 7/1955 Rucks ..... H01H 13/68 200/1 V

FOREIGN PATENT DOCUMENTS

JP S59-185676 U 12/1984
JP S60-164730 U 11/1985
(Continued)

*Primary Examiner* — Anthony R. Jimenez
(74) *Attorney, Agent, or Firm* — Metrolexis Law Group, PLLC

(57) ABSTRACT

A push button switch includes a housing made up of a base and a cover, a first plunger mounted on the cover so as to be pushed down, a movable contacting piece configured to be driven by a push-down operation on the first plunger, a movable contact provided in the movable contacting piece, and a fixed contact disposed so as to come into and out of contact with the movable contact. Specifically, the movable contacting piece includes a movable contact piece provided with the movable contact, and an operation tongue piece disposed on at least one side of the movable contact piece and coupled with the movable contact piece so as to rotate integrally. The operation tongue piece is operated by the operation body of the first plunger to bring the movable contact into and out of contact with the fixed contact.

12 Claims, 28 Drawing Sheets

(51) Int. Cl.
*H01H 13/06* (2006.01)
*H01H 13/70* (2006.01)

(58) Field of Classification Search
CPC .. H01H 3/00; H01H 3/02; H01H 3/12; H01H 13/00; H01H 13/50; H01H 2001/00; H01H 2001/12; H01H 2003/00; H01H 2003/02; H01H 2003/12; H01H 2205/00; H01H 1/00; H01H 1/06; H01H 1/12; H01H 1/14; H01H 1/36
USPC ..... 200/534
See application file for complete search history.

(56) References Cited

FOREIGN PATENT DOCUMENTS

| | | | |
|---|---|---|---|
| JP | S61-70331 | U | 5/1986 |
| JP | S63-140279 | A | 6/1988 |
| JP | H3-37722 | U | 4/1991 |
| JP | 2006-310226 | A | 11/2006 |

* cited by examiner

PUSH BUTTON SWITCH

TECHNICAL FIELD

The present invention relates to a push button switch, and particularly relates to a push button switch capable of performing a variety of operations.

BACKGROUND ART

As a conventional push button switch, for example, there has been a refrigerator-freezer door switch including: a case; a fixed contact terminal provided in a vicinity of a center of the case; first and second switches having first and second movable contact plates that, come into and out of contact with the fixed contact terminal; a third switch provided between the first and second switches and made up of a third movable contact plate that comes into and out of the fixed contact terminal via a pressing spring; and first and second actuating levers obtained by integrally forming, on both ends of the case, (i) actuating pieces that are projectable and sinkable and turn on pieces disposed at positions which come into and output contact with the pressing spring of the third switch so as to cross the first and second switches. The first and second switches are turned on when the first and second actuating levers project. The first and second switches are turned off when the first and second actuating levers sink. The third switch is turned on only when both the first and second actuating levers sink (cf. PTL 1).

CITATION LIST

Patent Literature

PTL 1: Japanese Unexamined Patent Application Publication No. S63-140279

SUMMARY OF INVENTION

Technical Problem

However, in recent years, a refrigerator-freezer has been required not only to achieve both a capacity increase and size reduction, but also to ensure an area for installation of a heat insulator from the viewpoint of energy saving. For this reason, a door switch used for detecting opening and closing of a refrigerator-freezer door has also be required for size reduction.

While rubber packing is typically used for the refrigerator-freezer door, in view of deterioration in rubber packing over time, a long operation stroke has been required from a detection position for opening and closing of the door to a pushing-in position.

Especially in some of door switches used for double doors adopted to middle-class and high-class refrigerator-freezers, a movable contact comes into contact with a fixed contact only when the both doors are closed (e.g., Japanese Unexamined Utility Model Application Publication No. H04-095288). In such a refrigerator-freezer switch, when a plunger is intended to be pushed-in to the pushing-in position so as to bring the movable contact into contact with the fixed contact by predetermined contact pressure, a long operation stroke is required in the plunger that drives the movable contact, thus causing the problem of not being able to reduce the size of the door switch.

It is an object of the present invention to provide a push button switch which is small in size and has a long operation stroke.

Solution to Problem

In order to solve the above problem, a push button switch according to the present invention includes: a housing made up of a base and a cover; at least one plunger mounted on the cover so as to be pushed down, and having an operation body at a tip of an operating arm portion projecting sideways from an inner surface of the plunger; a movable contacting piece configured to be driven by a push-down operation on the plunger; a movable contact provided in the movable contacting piece; and a fixed contact disposed so as to come into and out of contact with the movable contact. The movable contacting piece includes a movable contact piece provided with the movable contact, and an operation tongue piece disposed on at least one side of the movable contact piece and coupled with the movable contact piece so as to rotate integrally. The operation tongue piece is operated by the operation body of the plunger to bring the movable contact into and out of contact with the fixed contact.

Advantageous Effects of Invention

According to the present invention, since the movable contact piece and the operation tongue piece are formed in the movable contacting piece so as to rotate integrally, the operation can be performed using a small number of components. Hence it is possible to reduce a space occupied for internal components in the housing, and reduce the size of the push button switch.

Further, the operation tongue piece of the movable contacting piece can be operated by the operating arm portion projecting sideways from the inner surface of the plunger, to open and close the contacts. Hence it is possible to operate the movable contacting piece by use of the operating arm portion without increasing the size of the push button switch, while ensuring a long operation stroke.

As an embodiment of the present invention, it may be configured such that the movable contacting piece includes the movable contact piece provided with the movable contact, and the operation tongue pieces respectively disposed on both sides of the movable contact piece and coupled with the movable contact piece so as to rotate integrally. It may be configured such that a pair of the operation tongue pieces is respectively operated by a pair of the plungers to bring the movable contact into and out of contact with the fixed contact.

According to the present embodiment, in addition to the foregoing effect, it is possible to obtain a push button switch capable of detecting two objects to be detected, by use of one movable contact, while remaining small in size.

As another embodiment of the present invention, it may be configured such that, a first movable contacting piece and a second movable contacting piece are disposed so as to be symmetrical in the housing, the first movable contacting piece having the operation tongue piece disposed on one of both sides of the movable contact piece, the second movable contacting piece being formed so as to have a relation of a mirror-image centered on an imaginary surface that separates between the first movable contacting piece and the second movable contacting piece. It may be configured such that the operation tongue piece of the first movable contacting piece and the operation tongue piece of the second movable contacting piece are respectively operated by the pair of the plungers to respectively bring a first movable contact of the first movable contacting piece and a second movable contact of the second movable contacting piece into and out of contact with a first fixed contact and a second fixed contact.

According to the present embodiment, in addition to the foregoing effect, it is possible to obtain a push button switch capable of individually detecting two objects to be detected, while remaining small in size.

As another embodiment of the present invention, the foregoing first and second movable contacting pieces may be respectively disposed on both sides of the foregoing third movable contacting piece.

According to the present embodiment, it is possible to obtain a push button switch having a larger variety of detection patterns, while remaining small in size.

As a new embodiment of the present invention, the operation body may have an operation surface that smoothly slides on a surface of the operation tongue piece.

According to the present embodiment, an operation by the plunger provided with the operation body is smoothly performed, leading to improvement in operation feeling.

As a different embodiment of the present invention, the movable contacting piece may be bent in a substantially U-shape.

According to the present embodiment, since a distance between fulcrums of the movable contacting piece becomes long, a fatigue of the movable contacting piece due to stress is reduced to improve the durability.

As another embodiment of the present invention, the operation tongue piece may be bent so as to protrude toward the plunger.

According to the present embodiment, a sliding operation of the plunger is smoothly performed, enabling a smooth switching operation.

As another embodiment of the present invention, a pressing portion of the plunger may be on the same plane as a surface of the housing.

According to the present embodiment, the pressing portion of the plunger is less likely to be damaged by force, of impact from the outside, leading to improvement in design.

As a different embodiment of the present invention, the pair of the plungers may be formed so as to have a relation of a mirror-image centered on an imaginary surface that separates between the plungers.

According to the present embodiment, it is possible to obtain a push button switch which is easy to design and capable of performing a larger variety of operations.

As a new embodiment of the present invention, the pair of the movable contacting pieces may be formed so as have a relation of a mirror-image centered on an imaginary surface that separates between the movable contacting pieces.

According to the present embodiment, there is an effect of obtaining a push button switch which is easy to design and capable of performing a larger variety of operations.

DESCRIPTION OF EMBODIMENTS

Embodiments of a push button switch according to the present invention are described based on FIGS. 1 to 46.

As shown in FIGS. 1 to 25, a first embodiment is a push button switch mounted on a refrigerator-freezer having double doors, for example. The push button switch can detect four kinds of opening and closing states: a state where only a left door is closed; a state where only a right door is closed; a state where the right and left doors are simultaneously closed; and a state where the right and left doors are simultaneously open.

Figure 1:
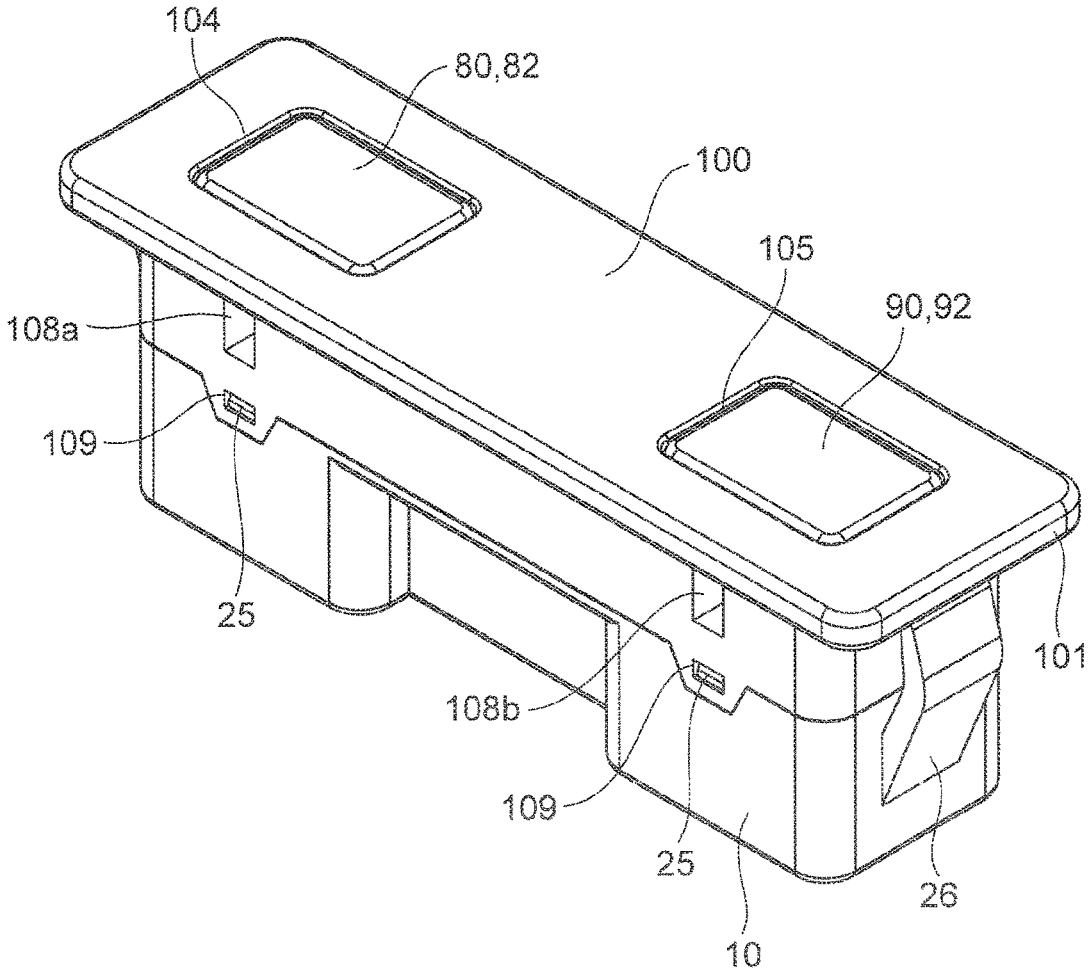
FIG. 1 is an overall perspective view showing a first embodiment of a push button switch according to the present invention.
Figure 2:
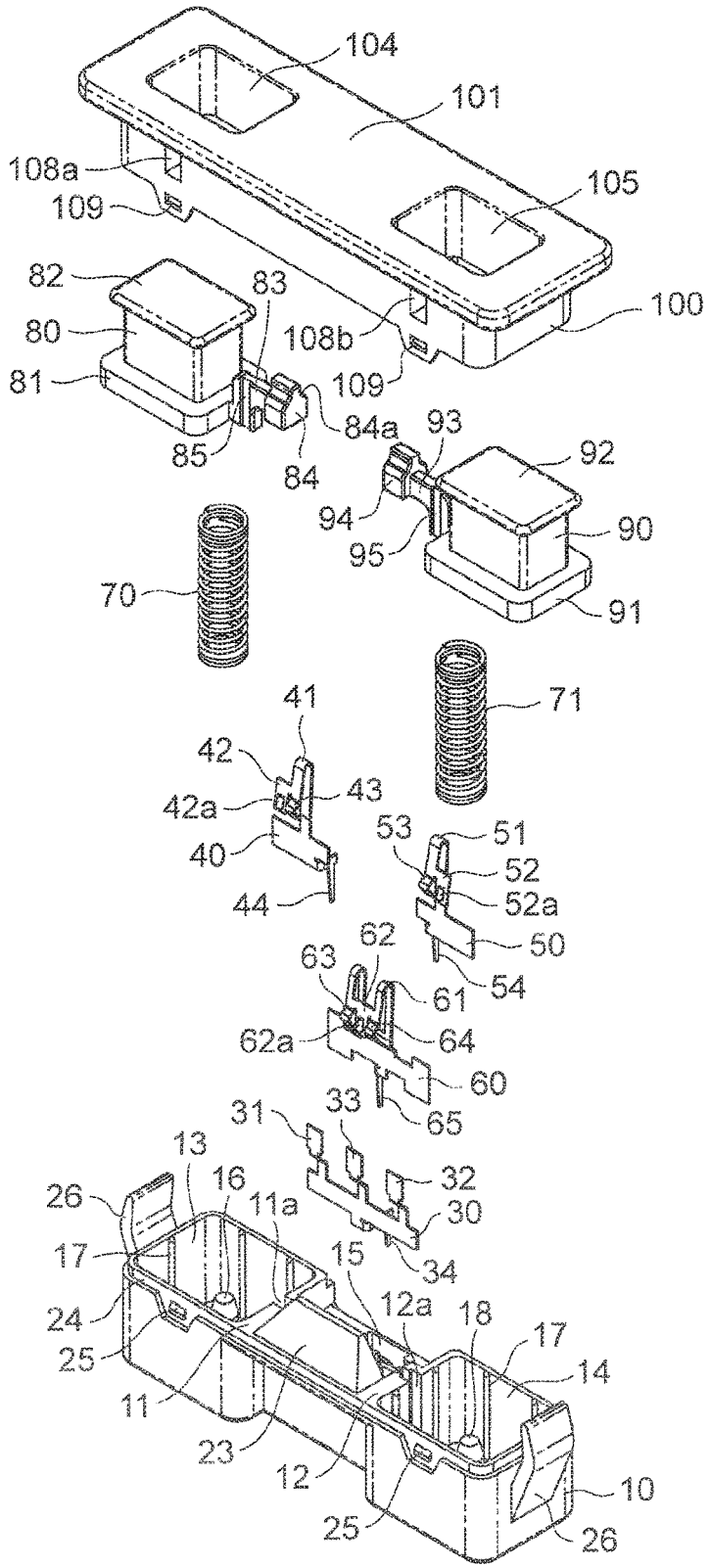
FIG. 2 is an exploded perspective view of the push button switch shown in FIG. 1.
Figure 3:
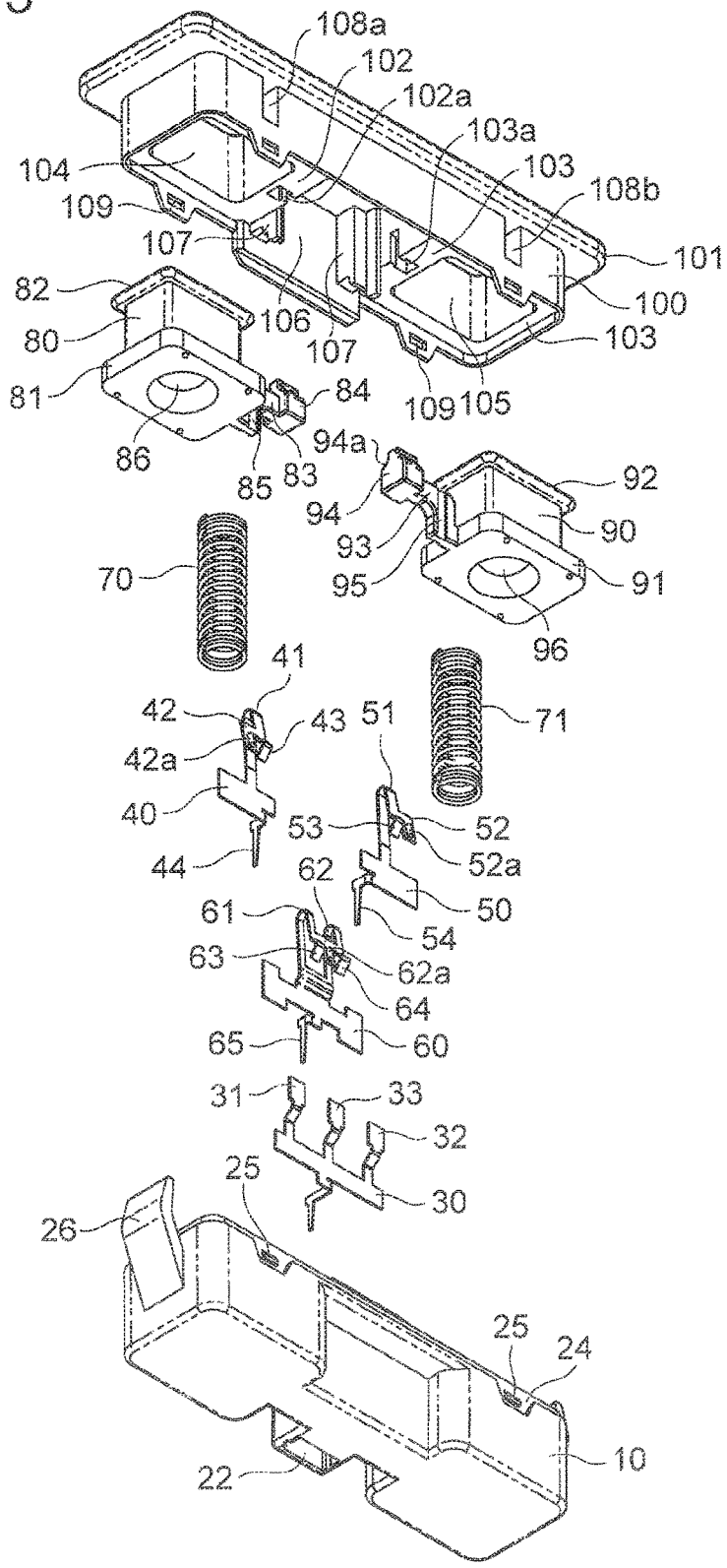
FIG. 3 is an exploded perspective view of the push button switch shown in FIG. 1, seen from a different angle.

As shown in FIGS. 2 and 3, the push button switch is roughly composed of a base 10, a common fixed contact terminal. 30, first and second movable contact terminals 40, 50, a third movable contact terminal 60, first and second return springs 70, 71, first and second plungers 80, 90, and a cover 100.

The base 10 has a flat rectangular boxed-shape, and is separated into three recesses of first, second, and third recesses 13, 14, 15 (FIG. 4) by two partition walls 11, 12 that projects on the bottom of the base 10. The partition walls 11, 12 are respectively provided with guide grooves 11*a*, 12*a* (FIG. 2) for communicating the adjacent first, second, and third recesses 13, 14, 15.

At the bottom center of the first recess 13, a support projection 16 is projected for supporting the first return spring 70 described later. Further, on the inner peripheral surface of the first recess 13, a positioning rib 17 is provided. The positioning rib 17 is provided so as to make frictional resistance small at the time when the first plunger 80 described later slides, and to prevent occurrence of wobbling.

Also in the second recess 14, as in the first recess 13, a support projection 18 and the positioning rib 17 are provided.

In the third recess 15, four terminal holes 21*a*, 21*b*, 21*c*, 21*d* (FIG. 10) are provided on a step 20 (FIG. 11) provided at the rear-side corner out of the facing corners of the bottom and located one level higher than the bottom, to form a connector 22. Further, in the third recess 15, a protrusion 23 is formed along the inner peripheral surface facing the step 20, and a positioning rib 23*a* is provided so as to be vertically along with the protrusion 23.

A fitting step 24 is provided along the outer-peripheral edge of an opening of the base 10, and engaging hook portions 25 are provided in the fitting step 24. Further, the short-side outer side surfaces of the base 10 are respectively provided with elastic hook portions 26, 26.

Figure 10:
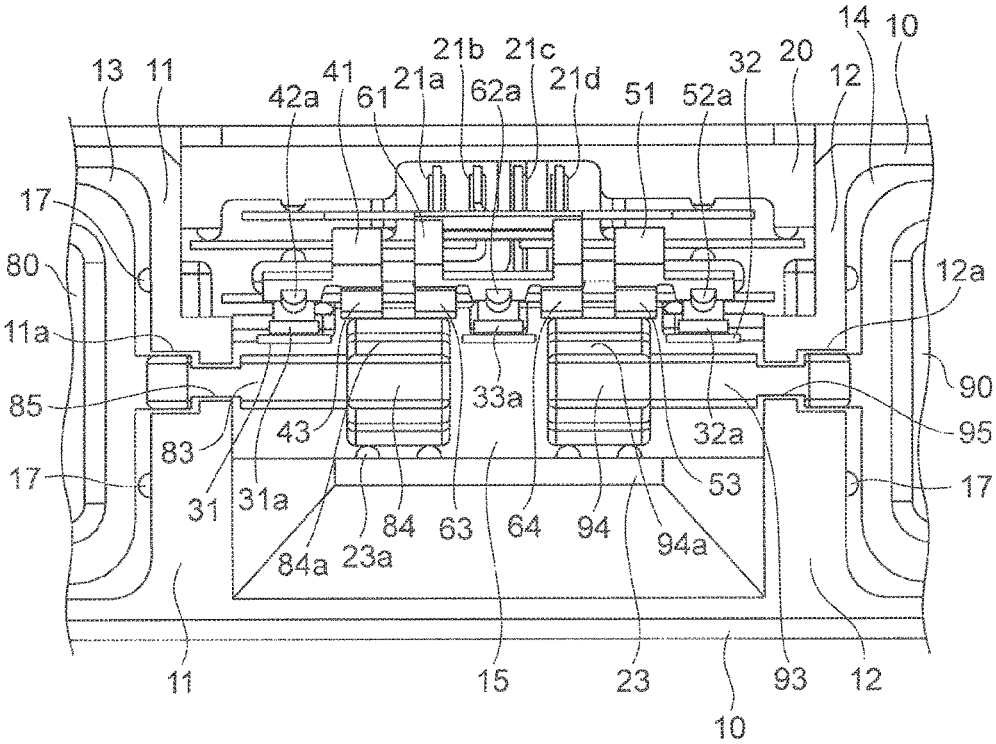
FIG. 10 is a partial enlarged view of FIG. 9.
Figure 11:
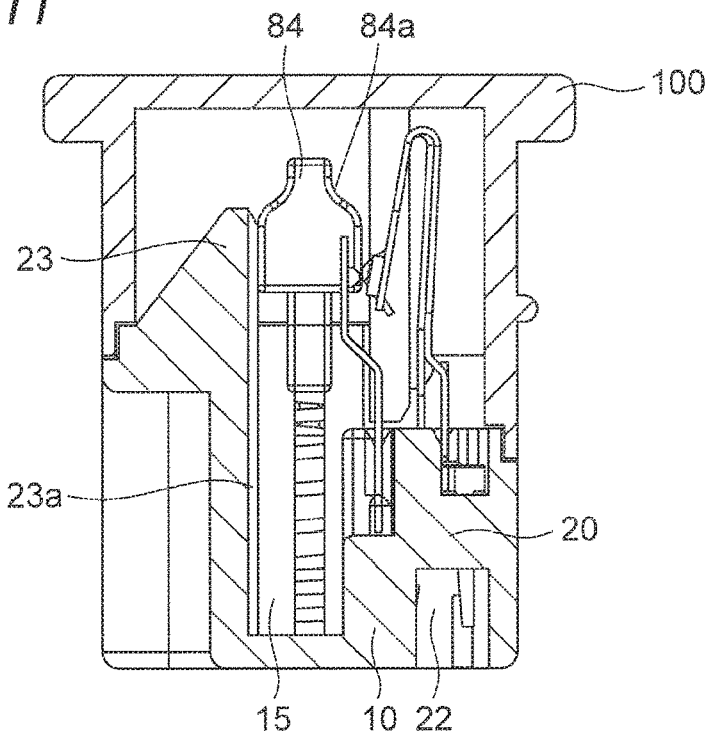
FIG. 11 is a front sectional view of the push button switch shown in FIG. 1.
Figure 12:
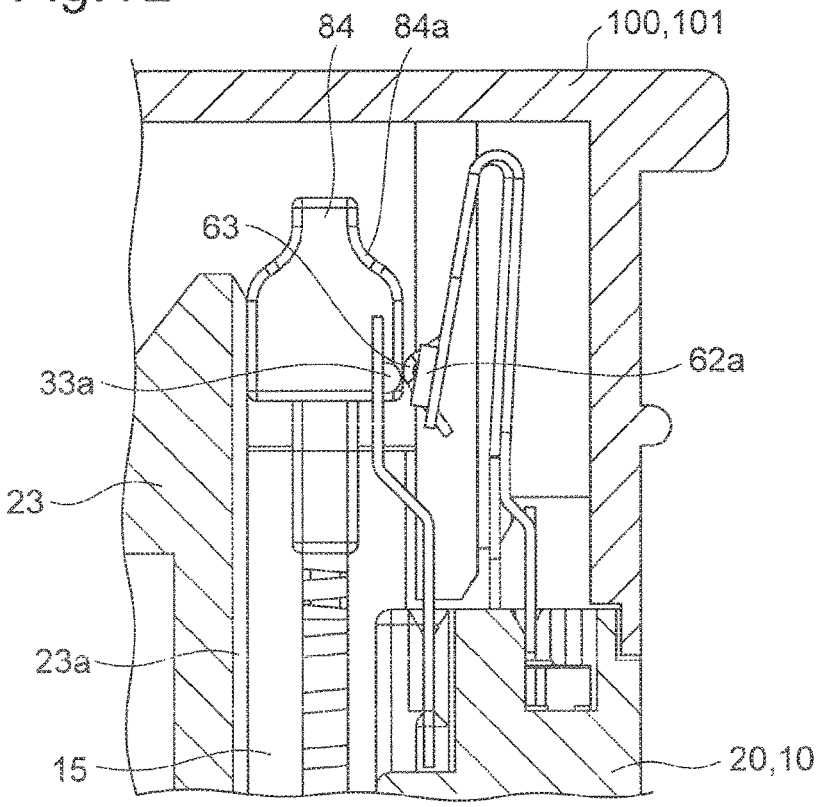
FIG. 12 is a partial enlarged view of FIG. 11.

Along the upper-side edge of the common fixed contact terminal 30, first, second, and third fixed contact pieces 31, 32, 33 are provided at predetermined pitches. The inner surfaces of the first, second, and third fixed contact pieces 31, 32, 33 are respectively provided with first, second, and third fixed contacts 31*a*, 32*a*, 33*a* (FIG. 10). A terminal portion 34 of the common fixed contact terminal 30 is then pressed into the terminal hole 21*c* of the base 10 and fixed in the terminal hole 21*c*.

The first movable contact terminal 40 has a movable contacting piece 41 bent in a substantially U-shape. A movable contact piece 42 and an operation tongue piece 43 are provided at the free end of the movable contacting piece 41 and coupled with each other so as to rotate integrally. A movable contact 42*a* is provided in the movable contact piece 42. A terminal portion 44 of the first movable contact terminal 40 is then pressed into the terminal hole 21*a* provided in the base 10 and fixed in the terminal hole 21*a*.

The second movable contact terminal 50 is formed so as to have the relation of a mirror-image centered on an imaginary surface that separates between the first movable contact terminal 40 and the second movable contact terminal 50. That is, both movable contact terminals have three-dimensional shapes that cannot be superimposed on each other like a right hand and a left hand. Thus, similarly to the first movable contact terminal 40, the second movable contact terminal 50 has a movable contacting piece 51 bent in a substantially U-shape. A movable contact piece 52 and an operation tongue piece 53 are provided at the free end of the movable contacting piece 51 and coupled with each other so as to rotate integrally. A movable contact 52*a* is provided in the movable contact piece 52. A terminal portion 54 of the second movable contact terminal 50 is then pressed into the terminal hole 21*d* provided in the base 10 and fixed in the terminal hole 21*d*.

A movable contacting piece 61 bent in a substantially U-shape is extended from the upper-side edge of the third movable contact terminal 60. Operation tongue pieces 63, 64 are respectively disposed on both sides of a movable contact piece 62 extended from the free end of the movable contacting piece 61, and coupled with each other so as to rotate integrally. A terminal portion 65 of the third movable contact terminal 60 is then pressed into the terminal hole 21*b* provided in the base 10 and fixed in the terminal hole 21*b*.

The first and second return springs 70, 71 are provided so as to apply spring forces for returning the first and second plungers 80, 90 described later to the original positions. The first and second return springs 70, 71 are then inserted respectively through the support projections 16, 18 of the base 10 to be positioned.

The lower end of the first plunger 80 is provided with a flange portion 81 capable of sliding in the first recess 13 of the base 10. The upper end of the first plunger 80 is provided with a pressing portion 82. Further, in the first plunger 80, an operation arm portion 83 bent at substantially a right angle is extended from the inner surface of the flange portion 81. The free end of the operation arm portion 83 is integrally molded with an operation body 84, and a base portion of the operation arm portion 83 is provided with a guide groove 85. As shown in FIG. 2, the operation body 84 has a substantially trapezoidal shape in a front view, and has an operation surface 84*a* on one side surface thereof. The operation surface 84*a* is a taper surface for smoothly operating the operation tongue pieces 43, 63. Note that the shape of the operation surface 84*a* is not necessarily limited to this shape, but may be the shape of an arc surface such as a parabolic shape, and can naturally be selected from a variety of shapes as necessary. Further, a housing hole 86 is provided on the bottom surface of the first plunger 80 (FIG. 3).

By housing the first return spring 70 in the housing hole 86 of the first plunger 80, the first plunger 80 is biased upward by the spring force of the first return spring 70.

The second plunger 90 is formed, so as to have the relation of a mirror-image centered on an imaginary surface that separates between the first plunger 80 and the second plunger 90. That is, both movable contact terminals have three-dimensional shapes that cannot be superimposed on each other like a right hand and a left hand. Thus, similarly to the first plunger 80, the lower end of the second plunger 90 is provided with a flange portion 91 capable of sliding in the second recess 14 of the base 10. The upper end of the second plunger 90 is provided with a pressing portion 92. Further, in the second plunger 90, an operation arm portion 93 bent at substantially a right angle is extended from the inner surface of the flange portion 91. The free end of one operation arm portion 93 is integrally molded with an operation body 94, and a base portion of the operation arm portion 93 is provided with a guide groove 95. As shown in FIG. 3, the operation body 94 has a substantially trapezoidal shape in a front view, and has an operation surface 94*a* on one side surface thereof. The operation surface 94*a* is a taper surface for smoothly operating the operation tongue pieces 64, 53. Note that the shape of the operation surface 94*a* is not necessarily limited to this shape, but may be the shape of an arc surface such as a parabolic shape, and can naturally be selected from a variety of shapes as necessary. Further, a housing hole 96 is provided on the bottom surface of the second plunger 90.

By housing the second return spring 71 into the housing hole 96 of the second plunger 90, the second plunger 90 is biased upward by the spring force of the second return spring 71.

The cover 100 has a boxed-shape with a flat surface that can be fitted to the base 10. A face plate 101 is integrally molded with the upper surface of the cover 100, and a pair of operation holes 104, 105 is formed by a pair of annular partition walls 102, 103. Hence the cover 100 is separated into three spaces, namely the operation holes 104, 105 and a center recess 106 (FIG. 3), by the annular partition walls 102, 103.

The cover 100 has guide grooves 102*a*, 103*a* provided on the inner surface which faces the annular partition walls 102, 103. The guide grooves 102*a*, 103*a* are respectively continued to the guide grooves 11*a*, 12*a* of the base 10. Retaining ribs 107, 107 are provided at corners of the center recess 106. Further, drain holes 108*a*, 108*b* that communicate with the operation holes 104, 105 are provided on one long-side side surface of the cover 100. Engaging holes 109 to be engaged with the engaging hook portions 25 of the base 10 are provided along the lower opening edge of the cover 100.

Next, an assembly procedure is described.

The terminal portion 44 of the first movable contact terminal 40, the terminal portion 65 of the third movable contact terminal 60, the terminal portion 34 of the common fixed contact terminal 30, and the terminal portion 54 of the second movable contact terminal 50 are respectively pressed into the terminal holes 21*a*, 21*b*, 21*c*, 21*d* of the base 10. When the common fixed contact terminal 30 and the first, second, and third movable contact terminals 40, 50, 60 are assembled onto the base 10, by spring forces of the movable contacting pieces 41, 51, 61 of their owns, the movable contacts 42*a*, 52*a*, 62*a* come into contact with the first, second, and third fixed contacts 31*a*, 32*a*, 33*a* at respective predetermined pressures.

The first and second return springs 70, 71 are then inserted through the support projections 16, 18 of the base 10.

Meanwhile, the first and second plungers 80, 90 are assembled into the operation holes 104, 105 of the cover 100 from the lower side. The first and second return springs 70, 71 are then assembled so as to be housed in the housing holes 86, 96 of the first and second plungers 80, 90, and the engaging holes 109 of the cover 100 are engaged with the engaging hooks portion 25 of the base 10, to complete the assembly operation.

At this time, the operation body 84 of the first plunger 80 presses the operation tongue piece 43 of the first movable contact terminal 40 and the operation tongue piece 63 of the third movable contact terminal 60. Further, the operation body 94 of the second plunger 90 presses the operation tongue piece 53 of the second movable contact terminal 50 and the operation tongue piece 64 of the third movable contact terminal 60. Accordingly, while the movable contact 42*a* is separated from the first fixed contact 31*a* and the movable contact 52*a* is separated from the second fixed contact 32*a*, the movable contact 62*a* is separated from the third fixed contact 33*a*.

Figure 23:
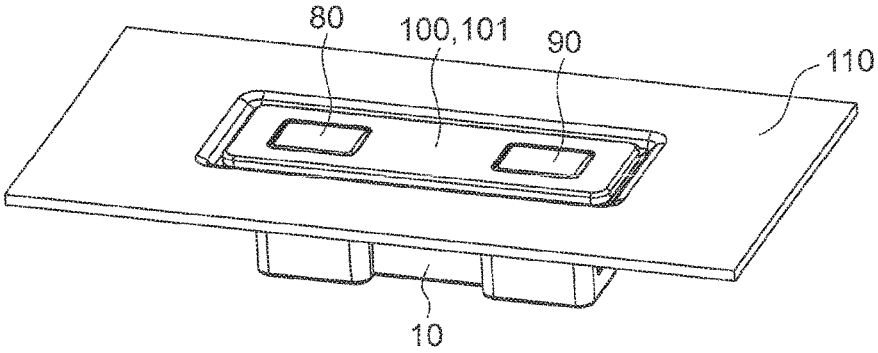
FIG. 23 is a perspective view showing a mounted state of the push button switch shown in FIG. 1.
Figure 24:
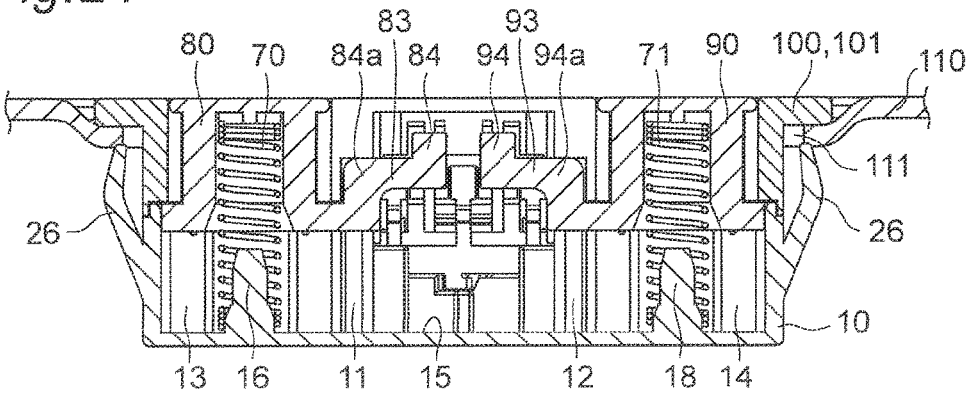
FIG. 24 is a side sectional view of FIG. 23.
Figure 25:
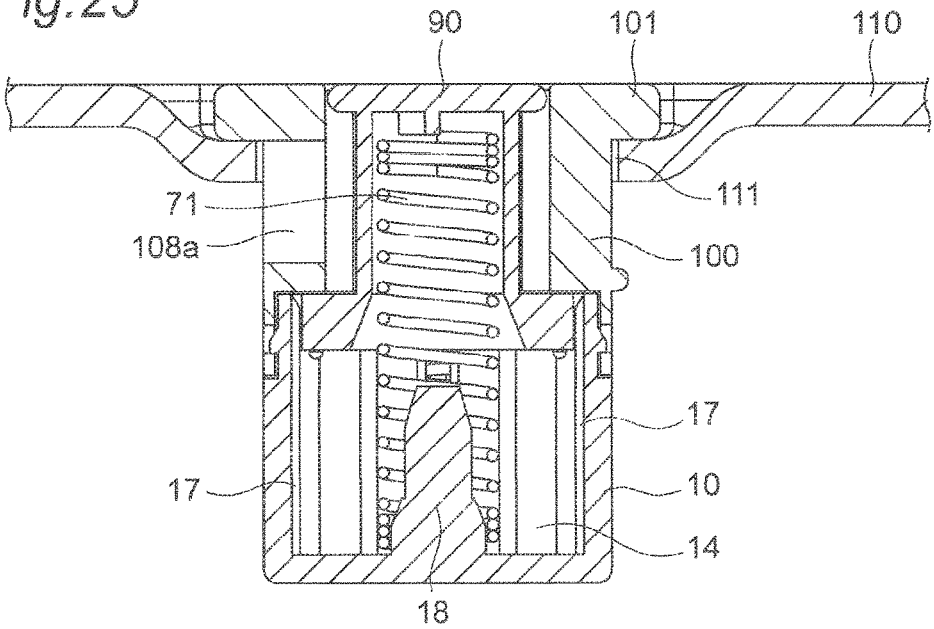
FIG. 25 is a front sectional view of FIG. 23.
Figure 26:
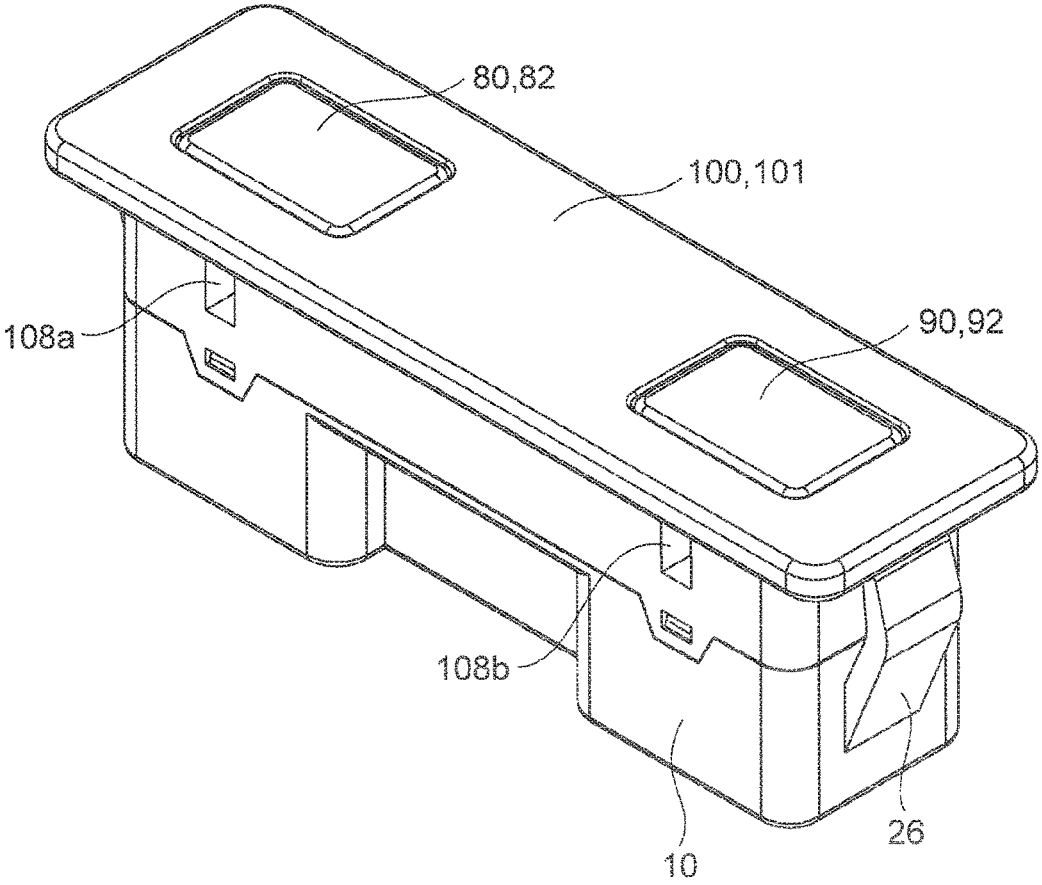
FIG. 26 is an overall perspective view showing a second embodiment of the push button switch according to the present invention.
Figure 27:
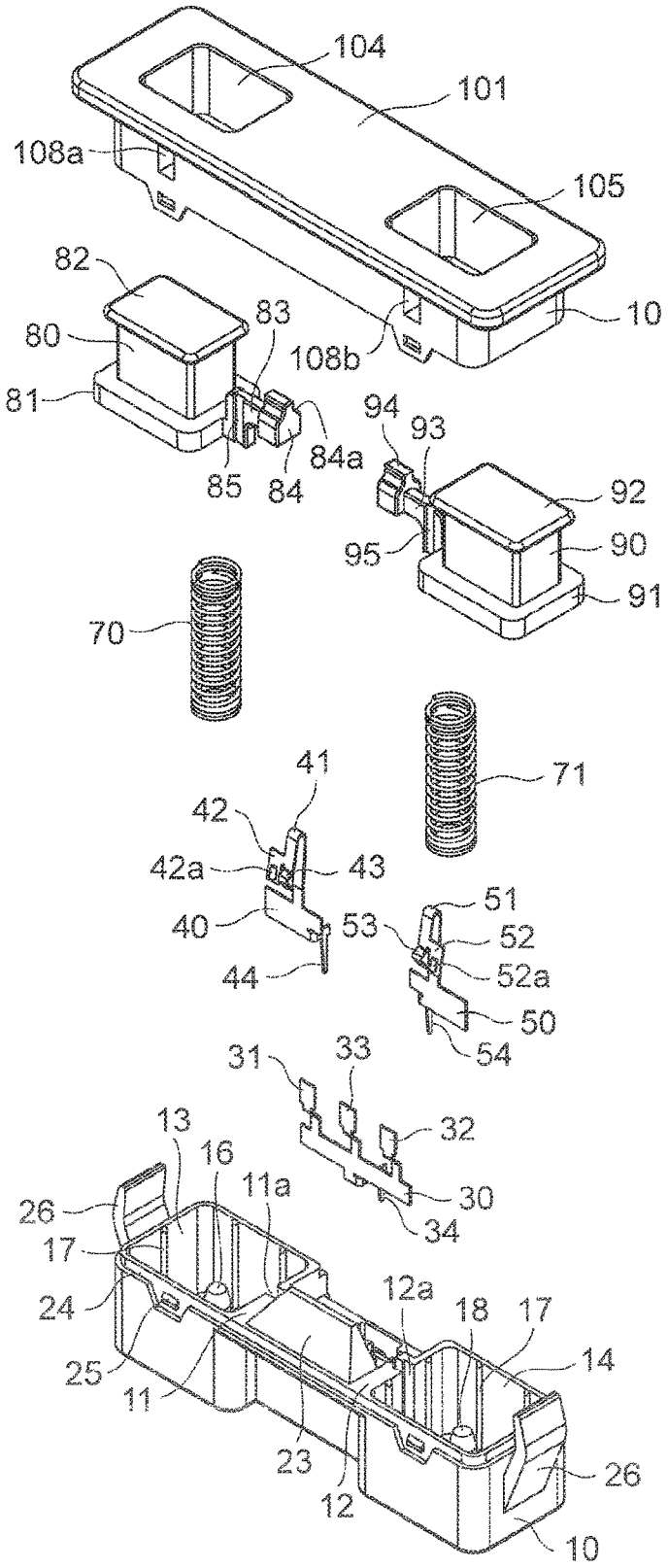
FIG. 27 is an exploded perspective view of the push button switch shown in FIG. 26.
Figure 28:
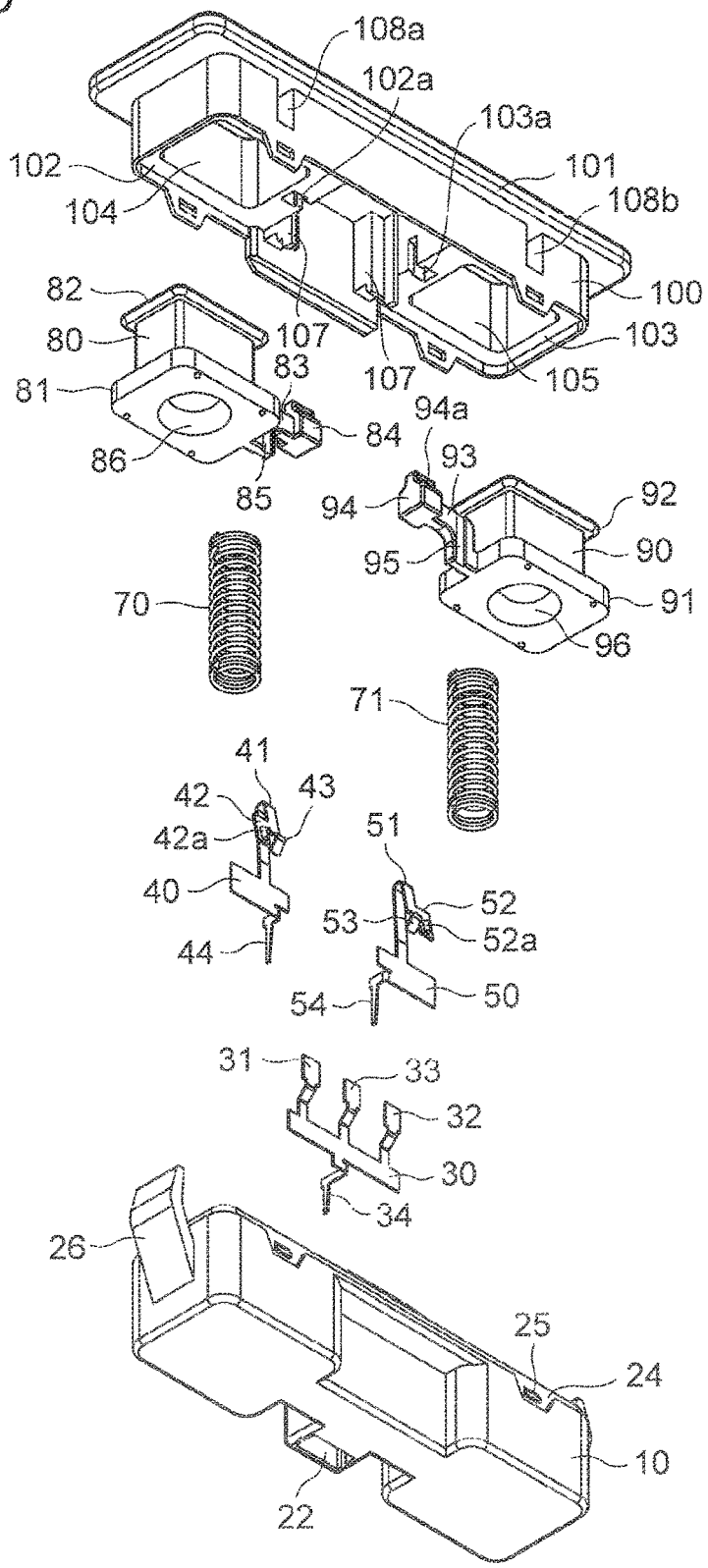
FIG. 28 is an exploded perspective view of the push button switch shown in FIG. 26, seen from a different angle.
Figure 29:
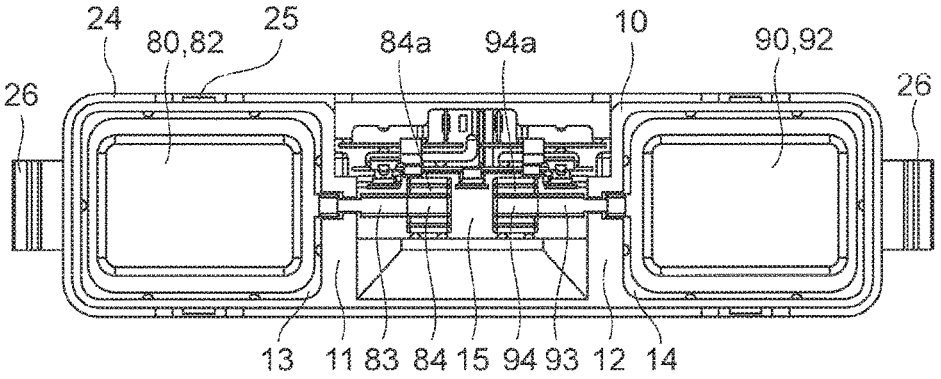
FIG. 29 is a plan view with a cover erased from the push button switch shown in FIG. 26.
Figure 30:
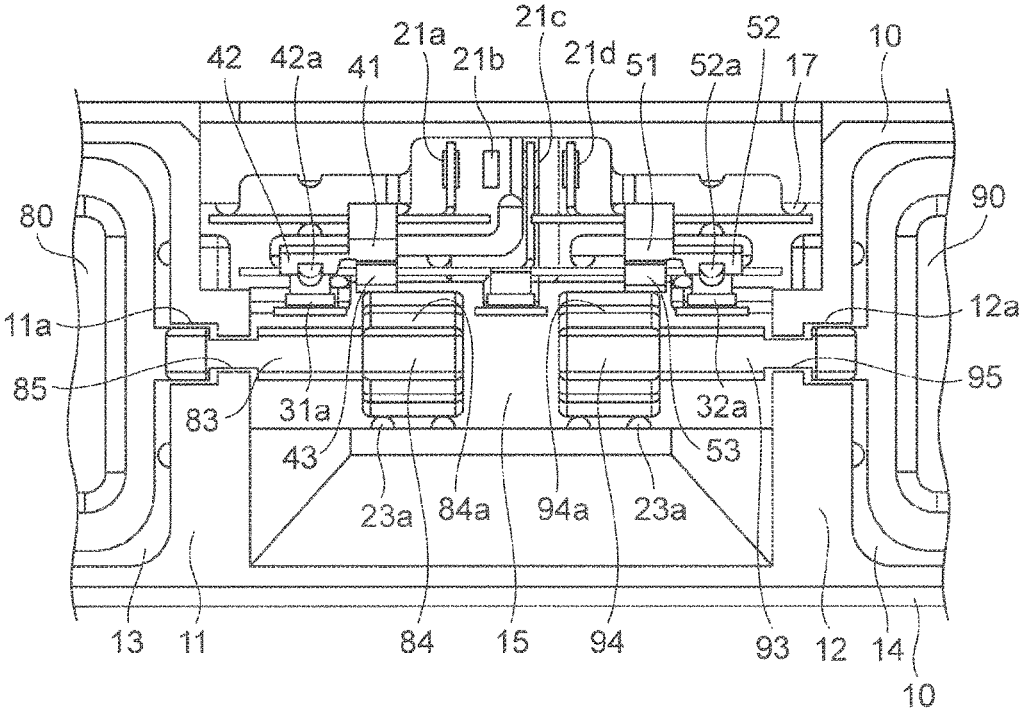
FIG. 30 is a partial enlarged view of FIG. 26.
Figure 31:
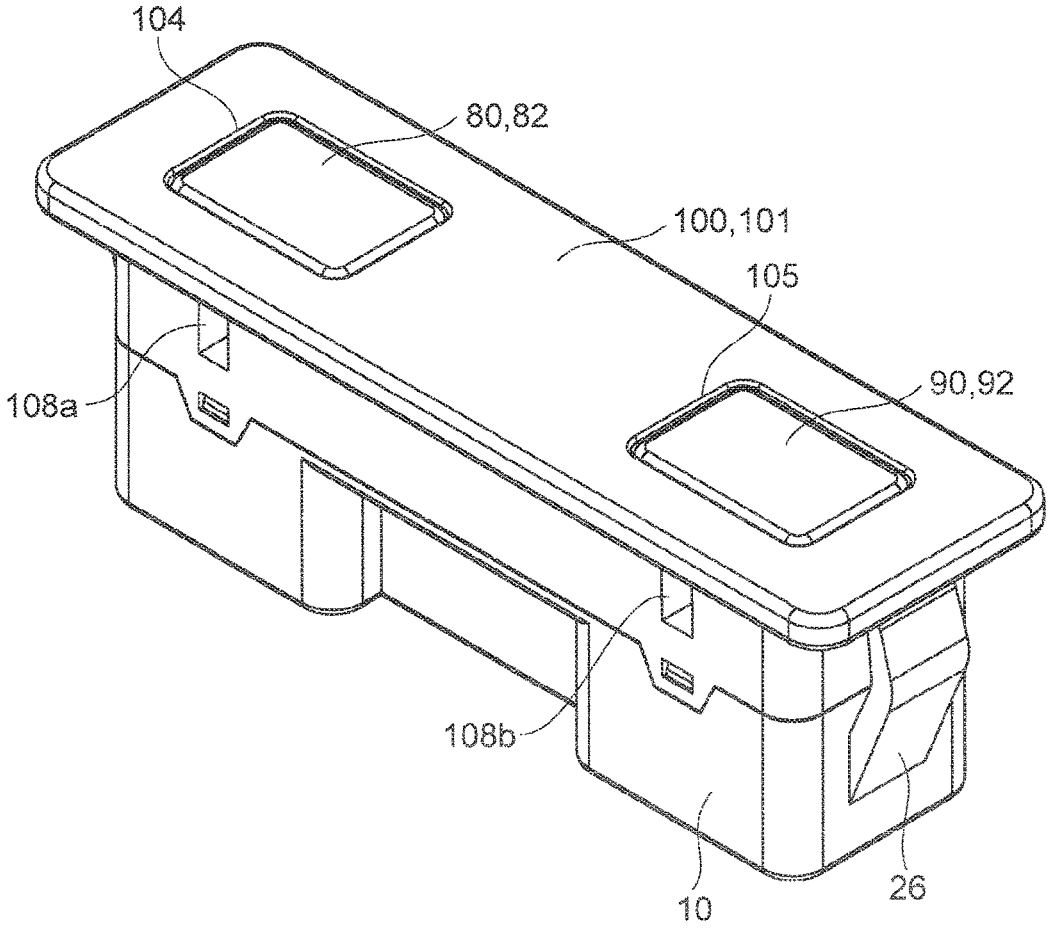
FIG. 31 is an overall perspective view showing a third embodiment of the push button switch according to the present invention.
Figure 32:
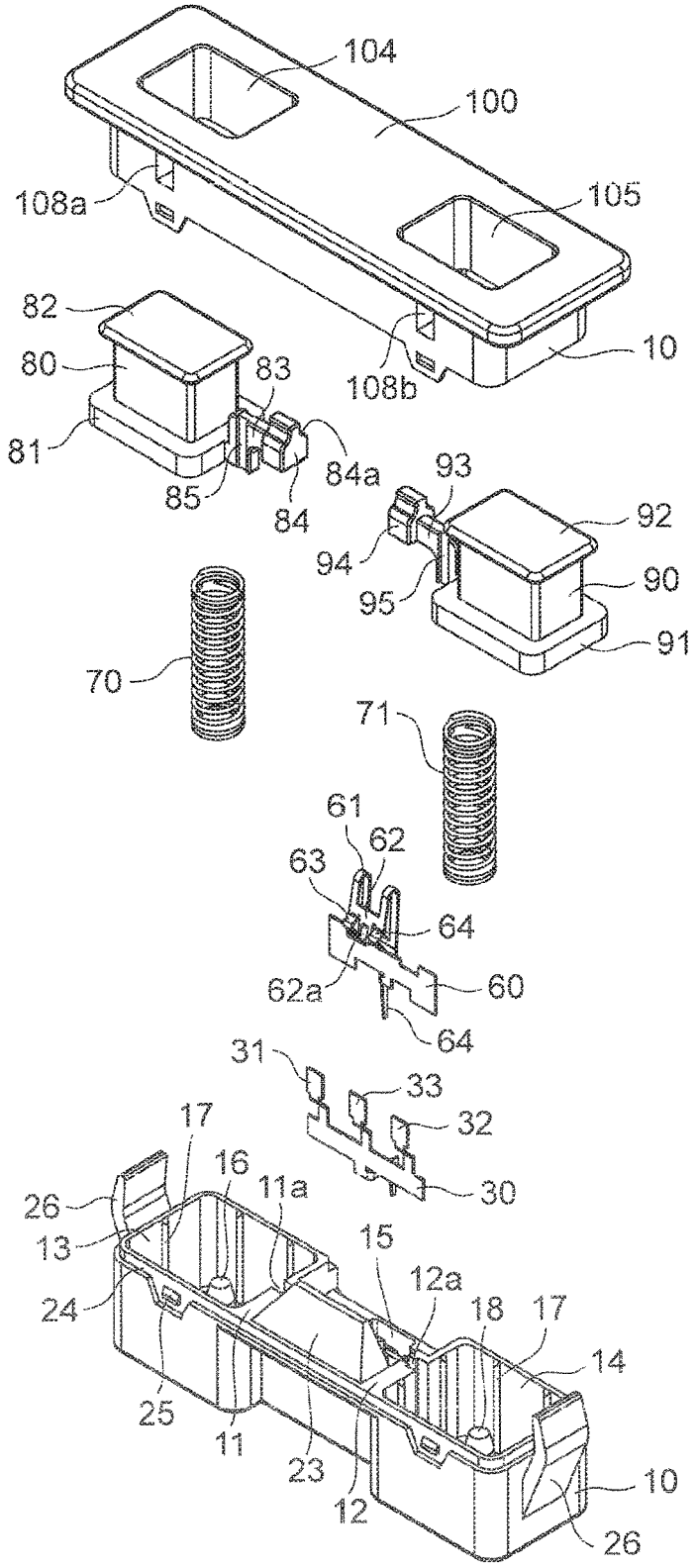
FIG. 32 is an exploded perspective view of the push button switch shown in FIG. 31.
Figure 33:
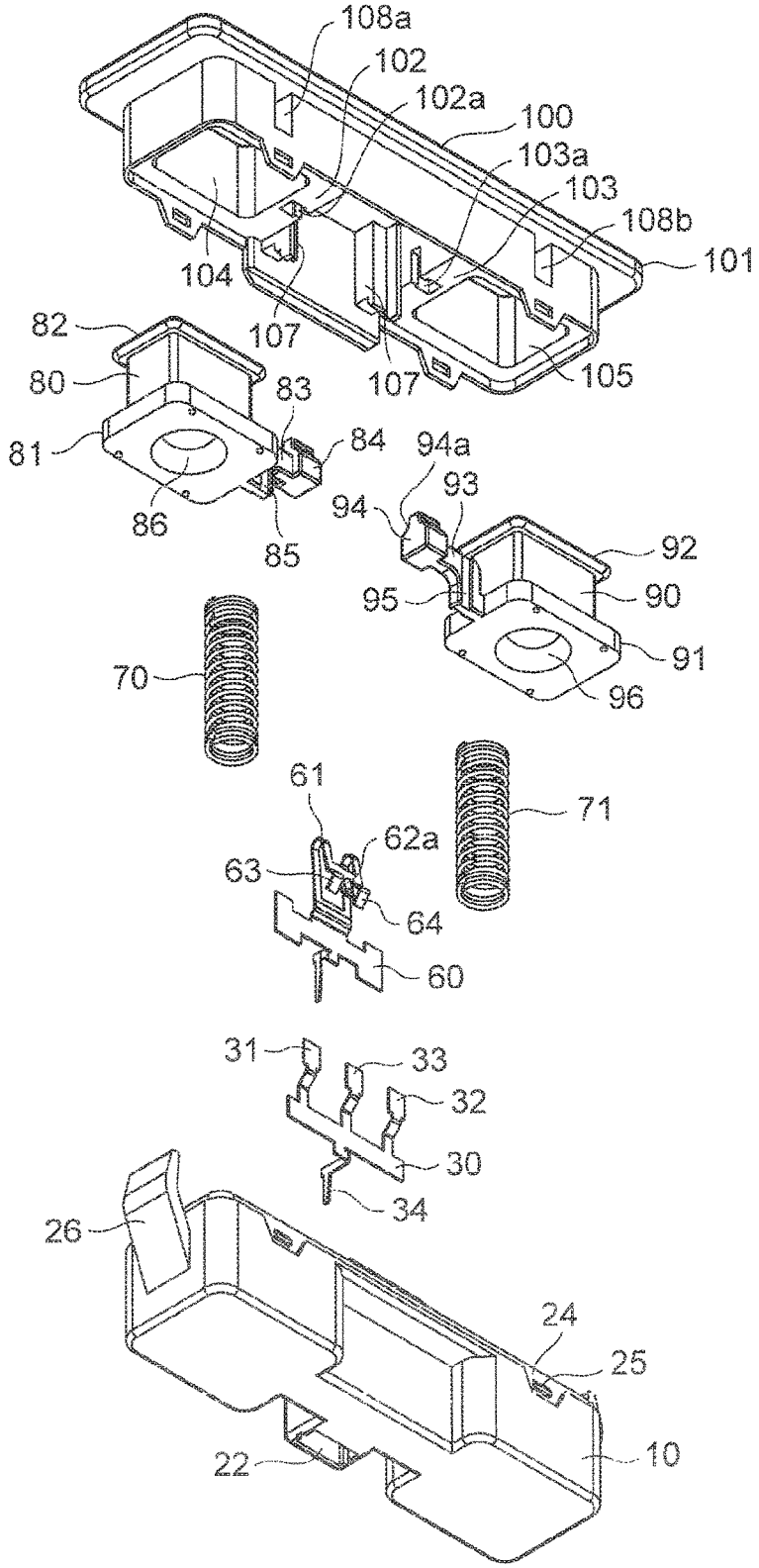
FIG. 33 is an exploded perspective view of the push button switch shown in FIG. 31, seen from a different angle.
Figure 34:
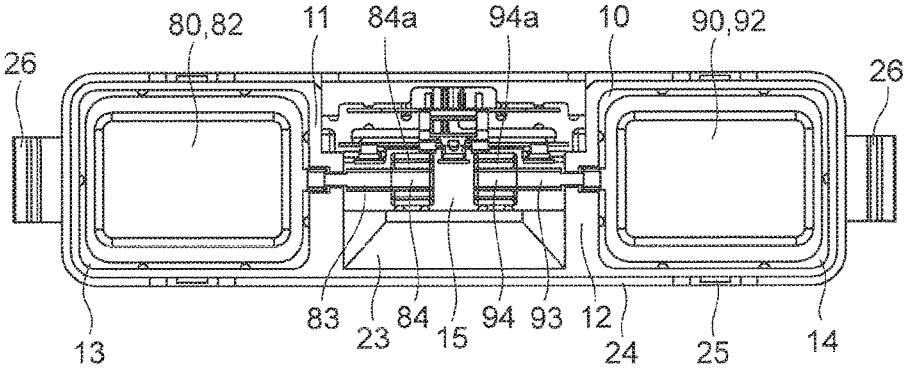
FIG. 34 is a plan view with a cover erased from the push button switch shown in FIG. 31.
Figure 35:
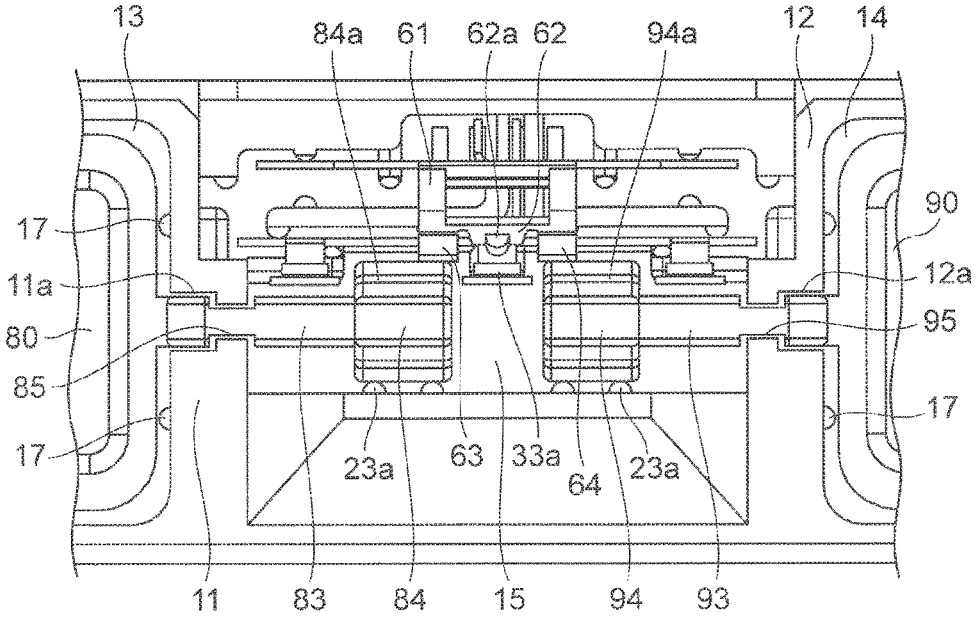
FIG. 35 is a partial enlarged view of FIG. 34.

Note that as shown in FIGS. 23 to 25, by inserting the push button switch from the base 10 side into the mounting hole 111 of the mounting plate 110, the elastic hook portions 26 are elastically transformed inward and then elastically returned. The opening edge of the mounting hole 111 of the mounting plate 110 is held between the elastic hook portions 26 and the face plate 101 of the cover 100, to retain the push button switch.

In particular, in the present embodiment, the opening edge of the mounting hole 111 is located one level lower. Thus, even when the push button switch is mounted, the surface of the face plate 101 is flush with the surface of the mounting plate 110. This results in a lowered possibility of force of impact from, the outside to act on the push button switch, and hence the push button is advantageous not only in being hardly damaged, but also in being beautiful in terms of design.

Further, even in use for a refrigerator or the like, the push button switch has such a waterproof structure as described below for preventing a short circuit and a return defect by preventing entry of a water drop and food juice.

That is, the space in which the first and second plungers 80, 90 are housed and the space in which the common fixed contact terminal 30 and the like are housed are separated by the partition walls 11, 12 of the base 10 and the annular partition walls 102, 103 of the cover 100. Hence it is possible to prevent entry and adhesion of a water drop, food juice, and the like from the outside into the space in which the common fixed contact terminal 30 and the like are disposed.

The common fixed contact terminal 30 and the like are assembled onto the step 20 that is one level higher than the bottom of the base 10. Thus, even if food juice enters the third recess 15 of the base 10, it hardly adheres to the first, second, and third fixed contacts 31*a*, 32*a*, 33*a*.

When the first and second plungers 80, 90 have been returned to the return positions, by the spring forces of the first and second return springs, the base portions of the operation arm portions 83, 93 are pressed and contacted onto the lower ends of the annular partition walls 102, 103 of the cover 100. This can effectively prevent entry of water and the like.

Further, the outer peripheral edges of the pressing portions 82, 92 of the first and second plungers 80, 90 are arc surfaces, and linearly in contact with the inner surfaces of the operation holes 104, 105 of the cover 100. This can prevent entry of water drops and food juice. In particular, there is an advantage in that, even when food juice is accumulated and solidified in gaps between the pressing portions 82, 92 and the operation holes 104, 105, the solidified state is destroyed as accompanied by the opening and closing operation of the switch, and a normal operation is performed.

The cover 100 is then provided with drain holes 108*a*, 108*b* that communicate with the operation holes 104, 105. Thus, even when water or the like enters the operation holes 104, 105, the water or the like can be drained to the outside via the drain holes 108*a*, 108*b* and prevented from entering deep inside.

Figure 4:
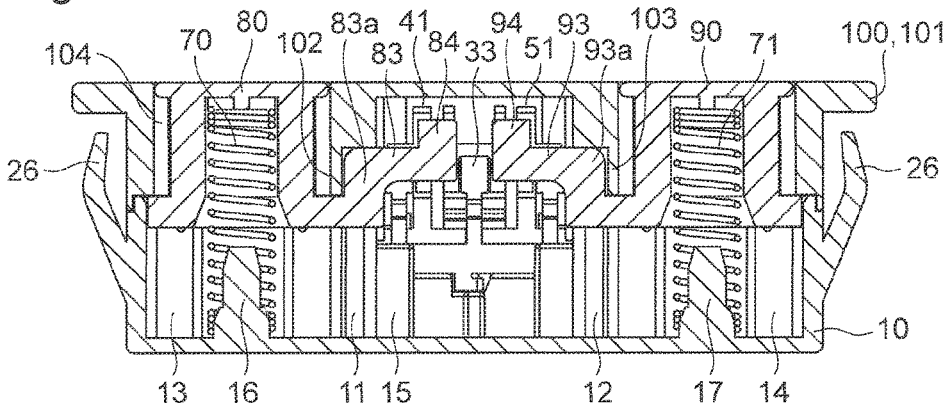
FIG. 4 is a side sectional view of the push button switch shown in FIG. 1.
Figure 5:
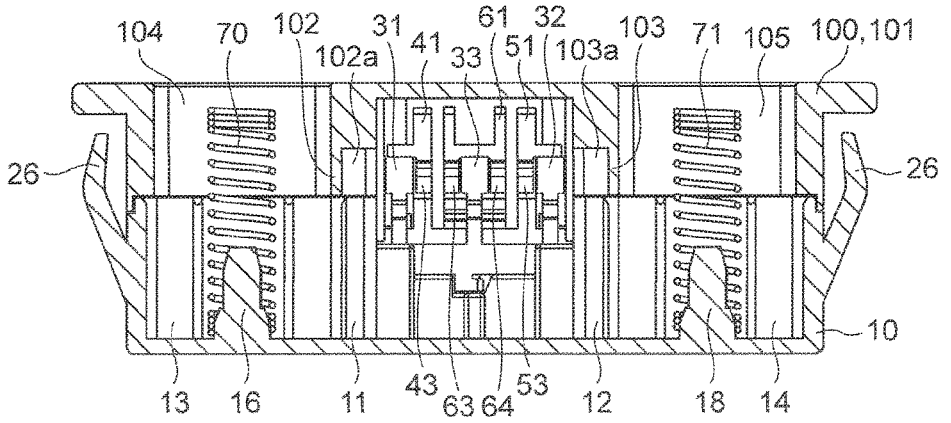
FIG. 5 is a side sectional view with first and second plungers erased from FIG. 4.
Figure 6:
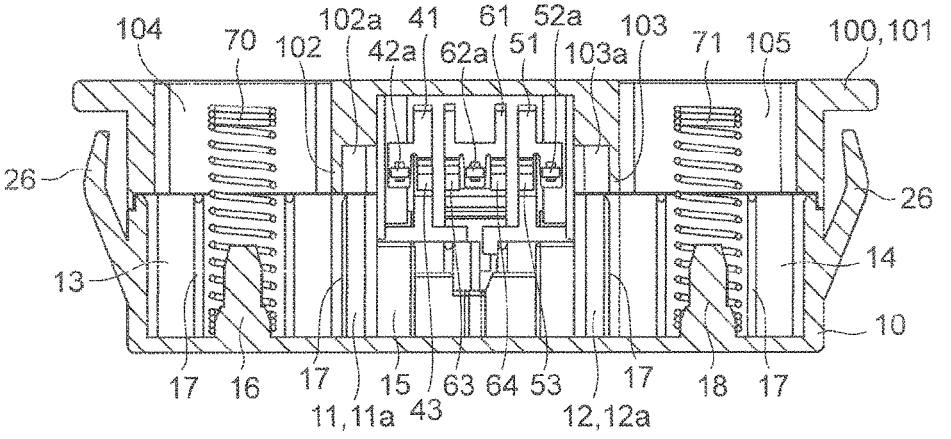
FIG. 6 is a side sectional view with a common fixed contact terminal erased from FIG. 5.
Figure 7:
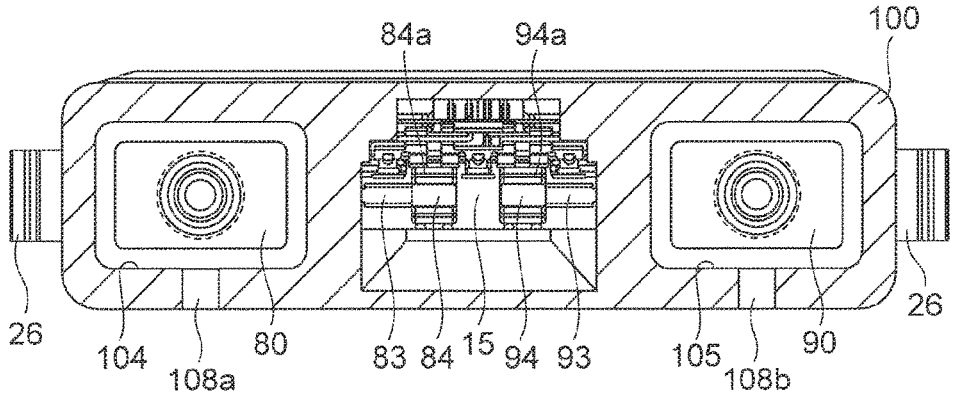
FIG. 7 is a horizontal sectional view of the push button switch shown in FIG. 1.
Figure 8:
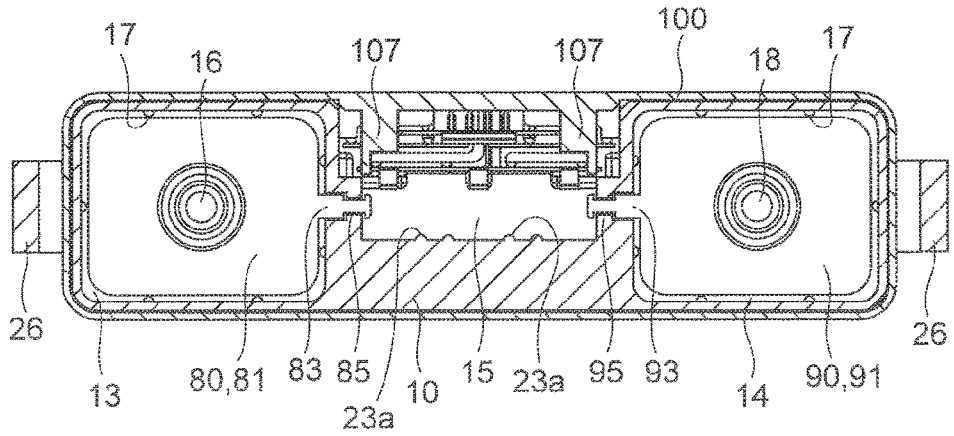
FIG. 8 is a horizontal sectional view of the push button switch cut off in a position different from FIG. 7.

Moreover, the operation arm portions 83, 93 of the first and second plungers 80, 90 are bent in a substantially L-shape. Hence the water having entered the operation holes 104, 105 do not get deep inside through the operation arm portions 83, 93. In particular, as shown in FIGS. 4 and 5, corner portions 83*a*, 93*a* of the operation arm portions 83, 93 are respectively fitted with the guide grooves 102*a*, 103*a* of the cover 100, thus leading to an advantage that a creeping distance becomes long and the entry of water or the like is more unlikely.

Next, a method for operating the push button switch is described.

Figure 9:
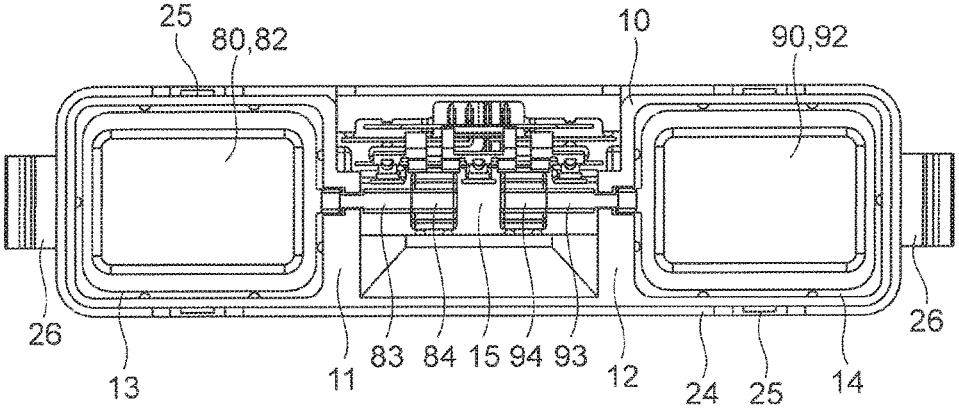
FIG. 9 is a plan view with a cover erased from the push button switch shown in FIG. 1.

First, when the first and second plungers 80, 90 are in returned positions before the operation, as shown in FIGS. 9 and 10, the operation surface 84*a* of the operation body 84 of the first plunger 80 presses the operation tongue piece 43 of the movable contacting piece 41 and the operation tongue piece 63 of the movable contacting piece 61. Further, the operation surface 94*a* of the operation body 94 of the second plunger 90 presses the operation tongue piece 53 of the second movable contact terminal 50 and the operation tongue piece 64 of the third movable contact terminal 60. Hence the movable contacts 42*a*, 52*a*, 62*a* are respectively separated from the first, second, and third fixed contacts 31*a*, 32*a*, 33*a*.

Figure 13:
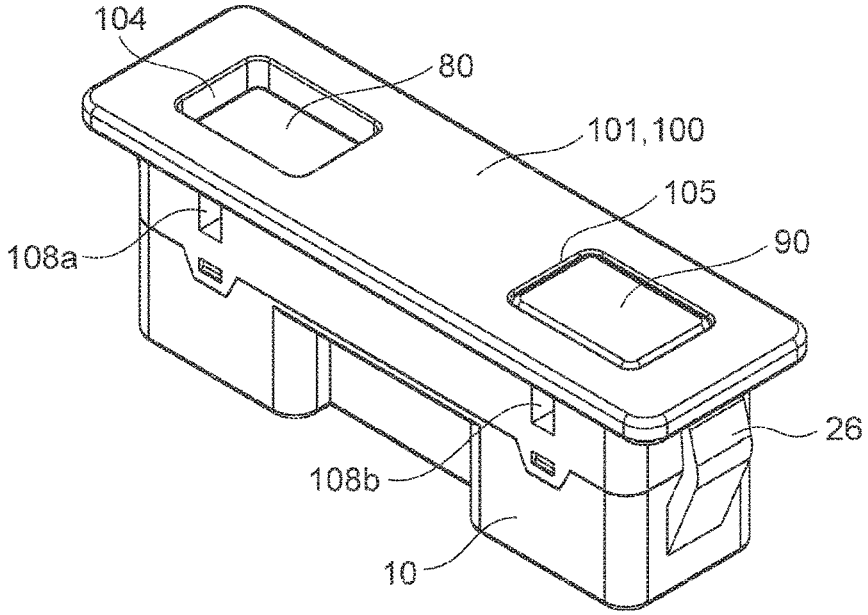
FIG. 13 is an overall perspective view showing the middle of operation of the push button switch shown in FIG. 1.
Figure 14:
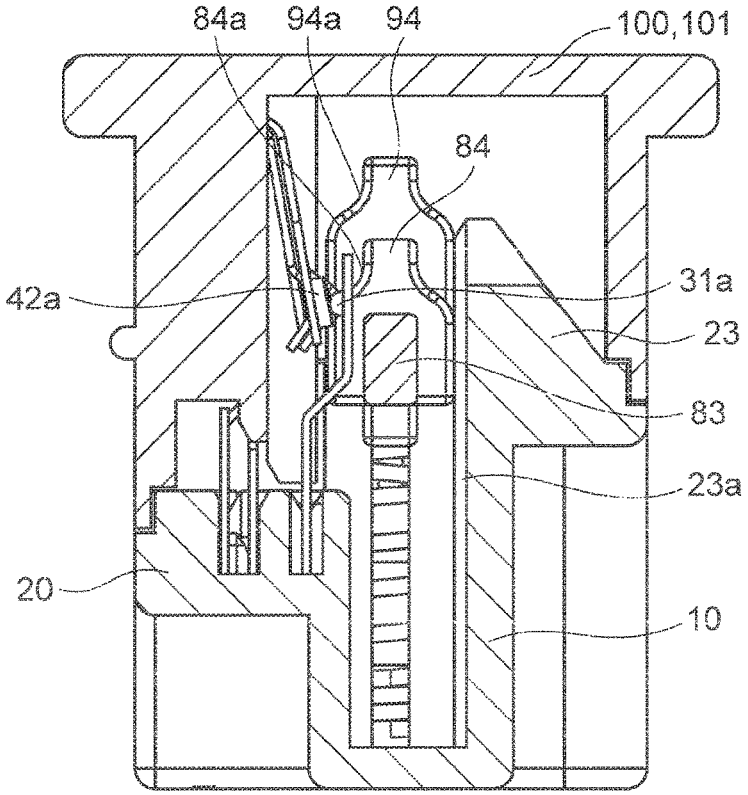
FIG. 14 is a front sectional view of FIG. 13.

Then, as shown in FIGS. 13 and 14, when only the first plunger 80 is pushed down, the operation body 84 is lowered and the operation surface 84*a* slides on the surface of the operation tongue piece 43, to reduce a load on the operation tongue piece 43. Hence the movable contacting piece 41 is elastically returned, and the movable contact 42*a* comes into contact with the first fixed contact 31*a*. In short, the movable contact 42*a* of the movable contacting piece 41 is displaced vertically to the pushing-in direction of the first plunger 80.

Figure 15:
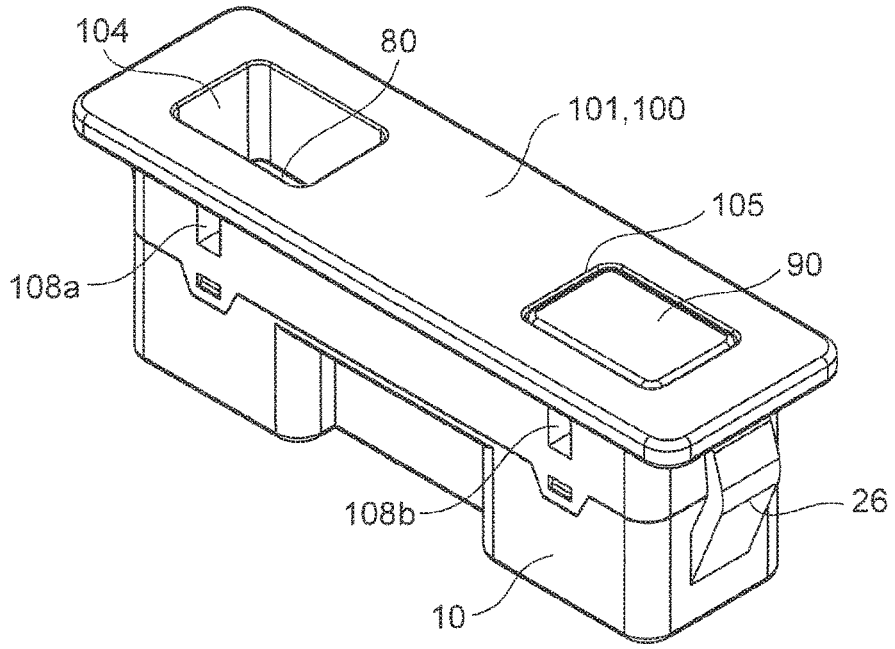
FIG. 15 is an overall perspective view showing a state after the operation of the push button switch shown in FIG. 1.
Figure 16:
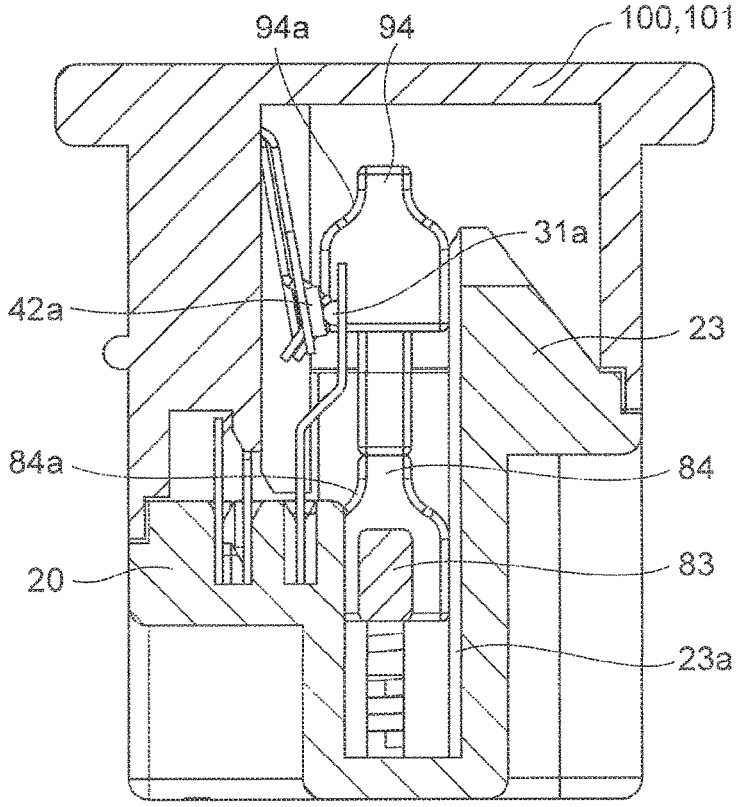
FIG. 16 is a front sectional view of FIG. 15.

As shown in FIGS. 15 and 16, when the first plunger 80 is further pushed down, the operation surface 84*a* of the operation body 84 is separated from the operation tongue piece 43, and no load is then applied on the operation tongue piece 43. The movable contact 42*a* comes into contact with the first fixed contact 31*a* with predetermined pressure.

Since the position of the operation tongue piece 64 in the movable contacting piece 61 of the third movable contact terminal 60 is regulated by the operation body 94 of the second plunger 90, the movable contact 62*a* does not come into contact with the third fixed contact 33*a*.

When the push-down operation on the first plunger 80 is released, the first plunger 80 is pushed back by spring force of the first return spring 70, and returned to the original position. Hence the operation body 84 rises, the operation surface 84*a* pushes back the operation tongue piece 43, and the movable contact 42*a* is separated from the first fixed contact 31*a*.

Figure 17:
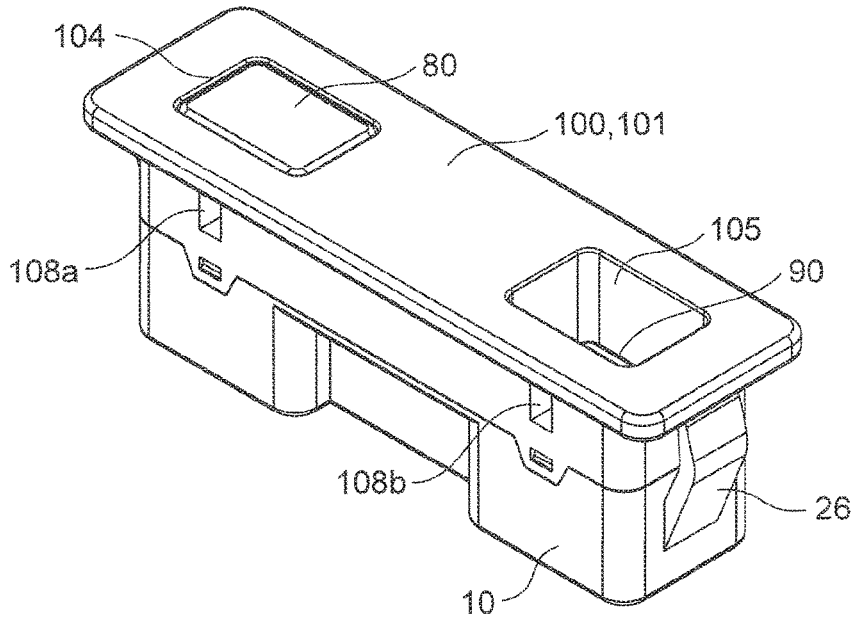
FIG. 17 is an overall perspective view showing a state after a different operation of the push button switch shown in FIG. 1.
Figure 18:
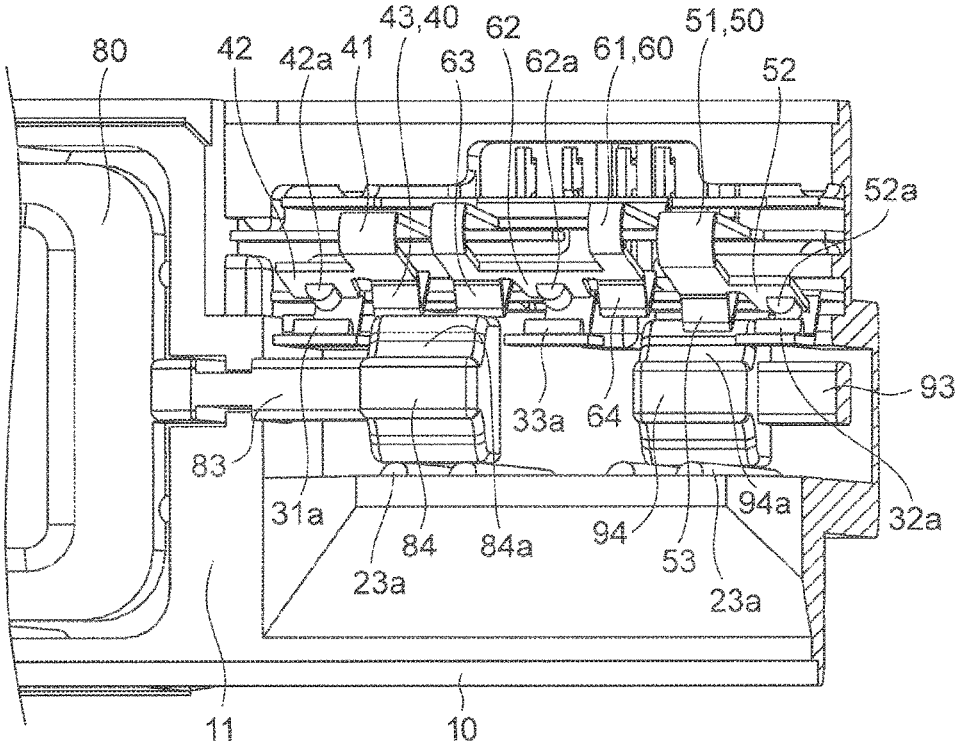
FIG. 18 is a partial enlarged perspective view with a cover erased from FIG. 17.

Then, as shown in FIGS. 17 and 18, when only the second plunger 90 is pushed down, the operation body 94 is lowered and the operation surface 94*a* slides on the surface of the operation tongue piece 53, to reduce a load on the operation tongue piece 53. Hence the movable contacting piece 51 is elastically returned, and the movable contact 52*a* comes into contact with the second fixed contact 32*a*. In short, the movable contact 52*a* of the movable contacting piece 51 is displaced vertically to the pushing-in direction of the second plunger 90.

When the second plunger 90 is further pushed down, the operation surface 94*a* of the operation body 94 is separated from the operation tongue piece 53. As shown in FIG. 18, no load is then applied on the operation tongue piece 53 from the operation body 94, and the movable contact 52*a* comes into contact with the second fixed contact 32*a* with predetermined pressure.

Since the position of the operation tongue piece 63 in the movable contacting piece 61 of the third movable contact terminal 60 is regulated by the operation body 84 of the first plunger 80, the movable contact 62*a* does not come into contact with the third fixed contact 33*a*.

When the push-down operation on the second plunger 90 is released, the second plunger 90 is pushed back by spring force of the second return spring 71, and returned to the original position. Hence the operation body 94 rises, the operation surface 94*a* pushes back the operation tongue piece 53, and the movable contact 52*a* is separated from the second fixed contact 32*a*.

Figure 19:
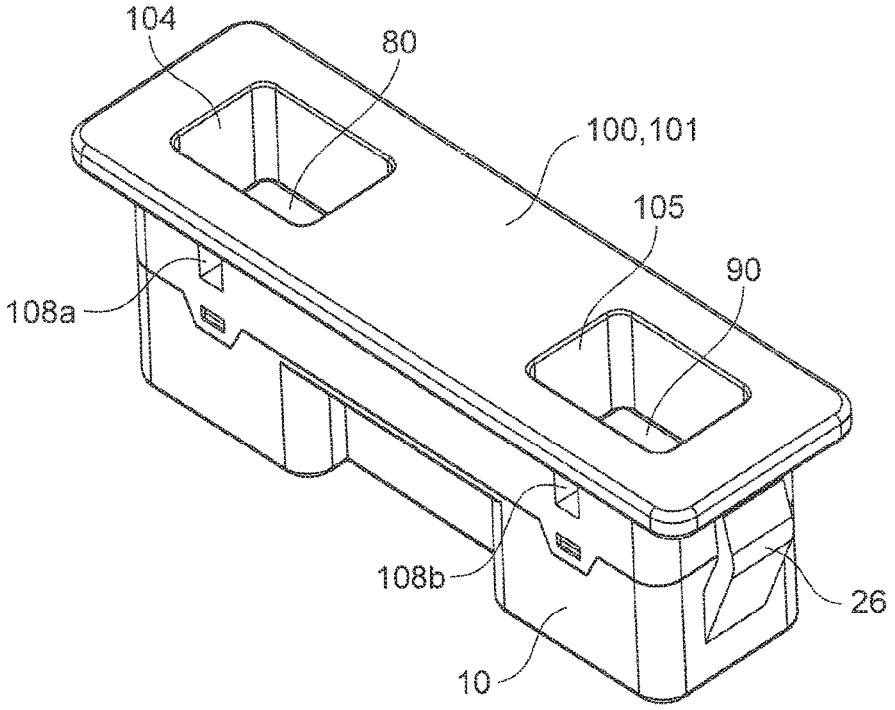
FIG. 19 is an overall perspective view showing a state after another operation of the push button switch shown in FIG. 1.
Figure 20:
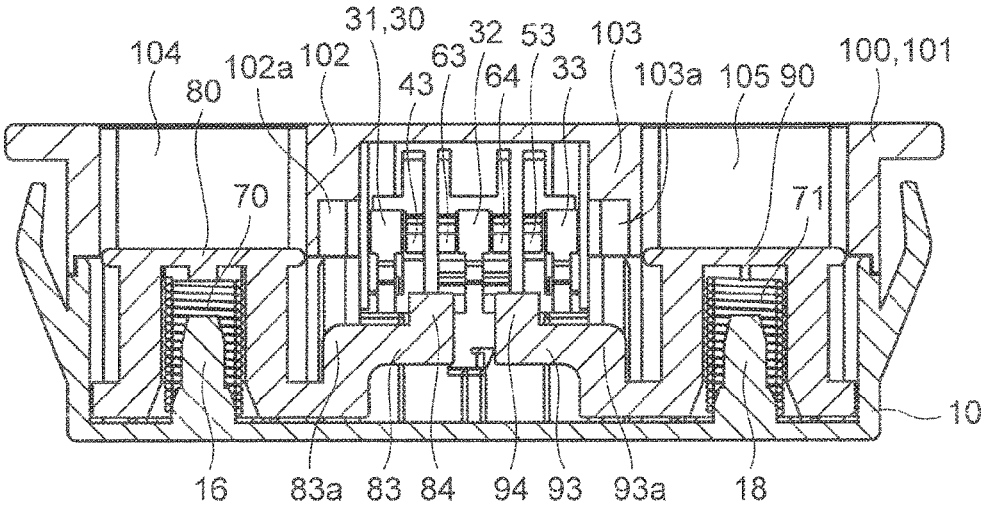
FIG. 20 is a side sectional view of FIG. 19.
Figure 21:
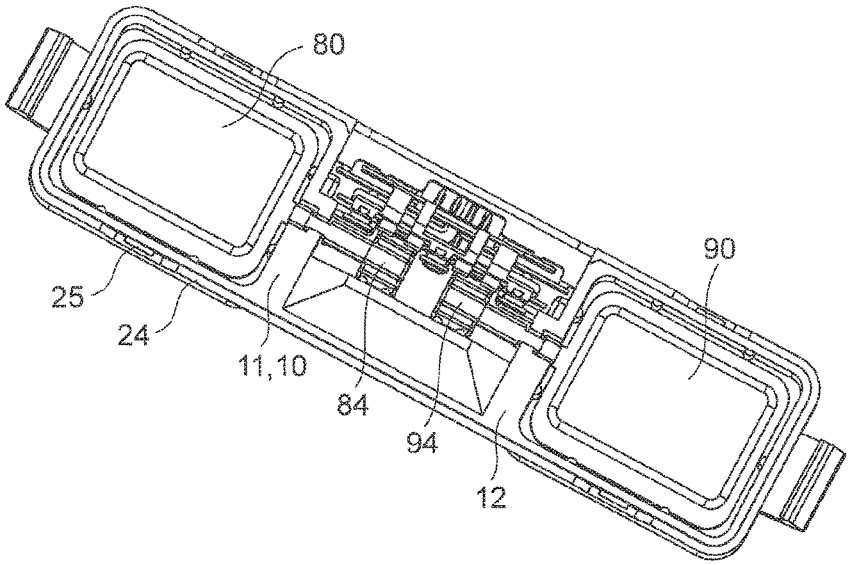
FIG. 21 is a perspective view with the cover erased from FIG. 19.
Figure 22:
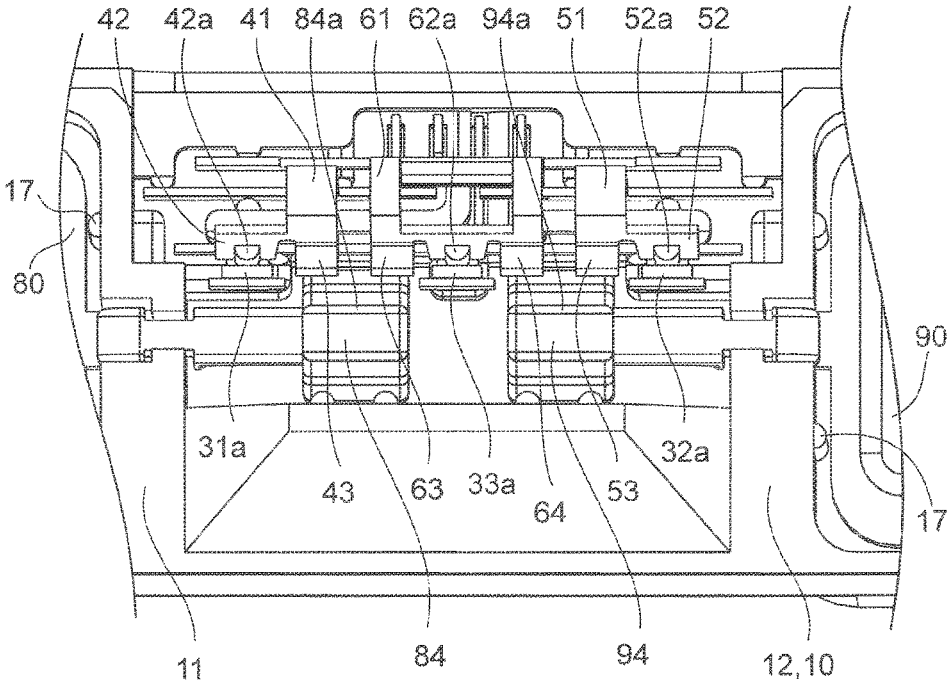
FIG. 22 is a partial enlarged perspective view of FIG. 21.

Then, as shown in FIGS. 19 and 22, when the first and second plungers are simultaneously pushed down, the operation bodies 84, 94 are lowered and the operation surface 84*a* slides on the surfaces of the operation tongue pieces 43, 63, while the operation surface 94*a* slides on the surfaces of the operation tongue pieces 64, 53, to reduce loads on the operation tongue pieces 43, 63, 64, 53. Hence the movable contacting pieces 41, 61, 51 are elastically returned, and the movable contacts 42*a*, 62*a*, 52*a* respectively come into contact with the first, third, and second fixed contacts 31*a*, 33*a*, 32*a*.

Further, when the first and second plungers 80, 90 are further pushed down, the operation surfaces 84*a*, 94*a* of the operation bodies 84, 94 are separated from the operation tongue pieces 43, 63, 64, 53, and no load is then applied on the movable contacting pieces 41, 61, 51 from the operation bodies 84, 94. The movable contacts 42*a*, 62*a*, 52*a* respectively come into contact with the first, third, and second fixed contacts 31*a*, 33*a*, 32*a* with predetermined pressures.

When the push-down operations on the first and second plungers 80, 90 are released, the first and second plungers 80, 90 are pushed back by the spring forces of the first and second return springs 70, 71, and returned to the original positions. Hence the operation bodies 84, 94 rise, the operation surfaces 84*a*, 94*a* respectively push back the operation tongue pieces 43, 53 and the operation tongue pieces 63, 64, and the movable contacts 42*a*, 62*a*, 52*a* are respectively separated from, the first, third, and second fixed contacts 31*a*, 33*a*, 32*a*.

A second embodiment has the same basic structure as that of the foregoing first, embodiment except that the third movable contact terminal 60 is not incorporated as shown in FIGS. 26 to 30. Since the others are similar to those in the foregoing first embodiment, the same numerals are provided to the same portions and descriptions thereof are omitted.

According to the present embodiment, only by operating the first and second plungers 80, 90, it is possible to obtain a push button switch with the movable contacts 42*a*, 52*a* respectively coming into contact with the first and second fixed contacts 31*a*, 32*a*.

A third, embodiment has the same basic structure as that of the foregoing first embodiment except that the first and second movable contact terminals 40, 50 are not incorporated as shown in FIGS. 31 to 35. Since the others are similar to those in the foregoing first embodiment, the same numerals are provided to the same portions and descriptions thereof are omitted.

According to the present embodiment, only when the first and second plungers 80, 90 are simultaneously operated, it is possible to obtain a push button switch with the movable contact 62*a* coming into contact with the third fixed contact 33*a*.

Figure 36:
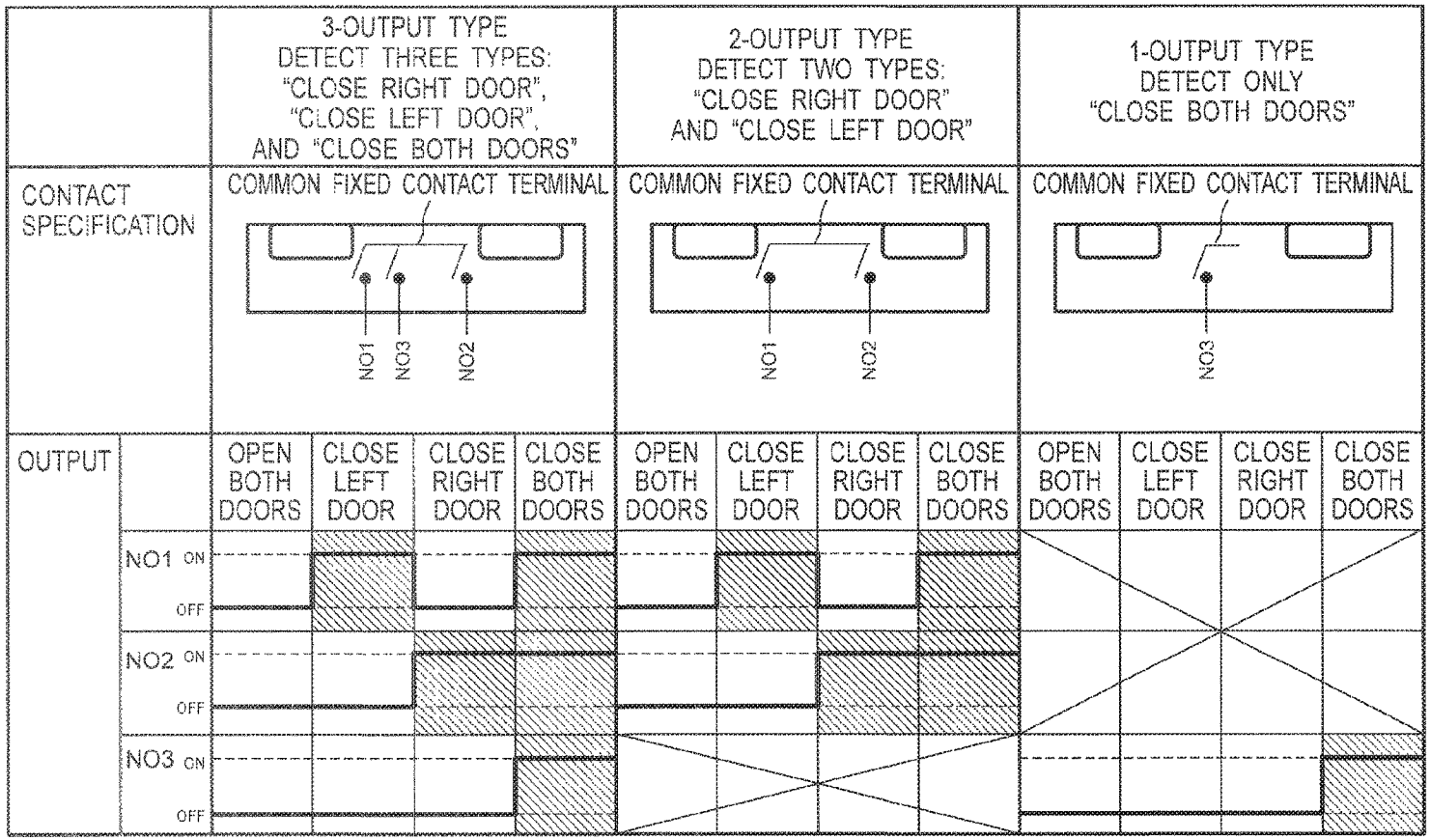
FIG. 36 is a time chart showing opening and closing operations of an electromagnetic relay according to the first, second, and third embodiments.

In order to facilitate understanding of the foregoing operation process, FIG. 36 shows a time chart summarizing the case of applying the push button switch to a refrigerator-freezer with double doors and detecting opening and closing of the double doors.

A fourth embodiment is a push button switch having only the first plunger 80 as shown in FIGS. 37 to 46.

Figure 43:
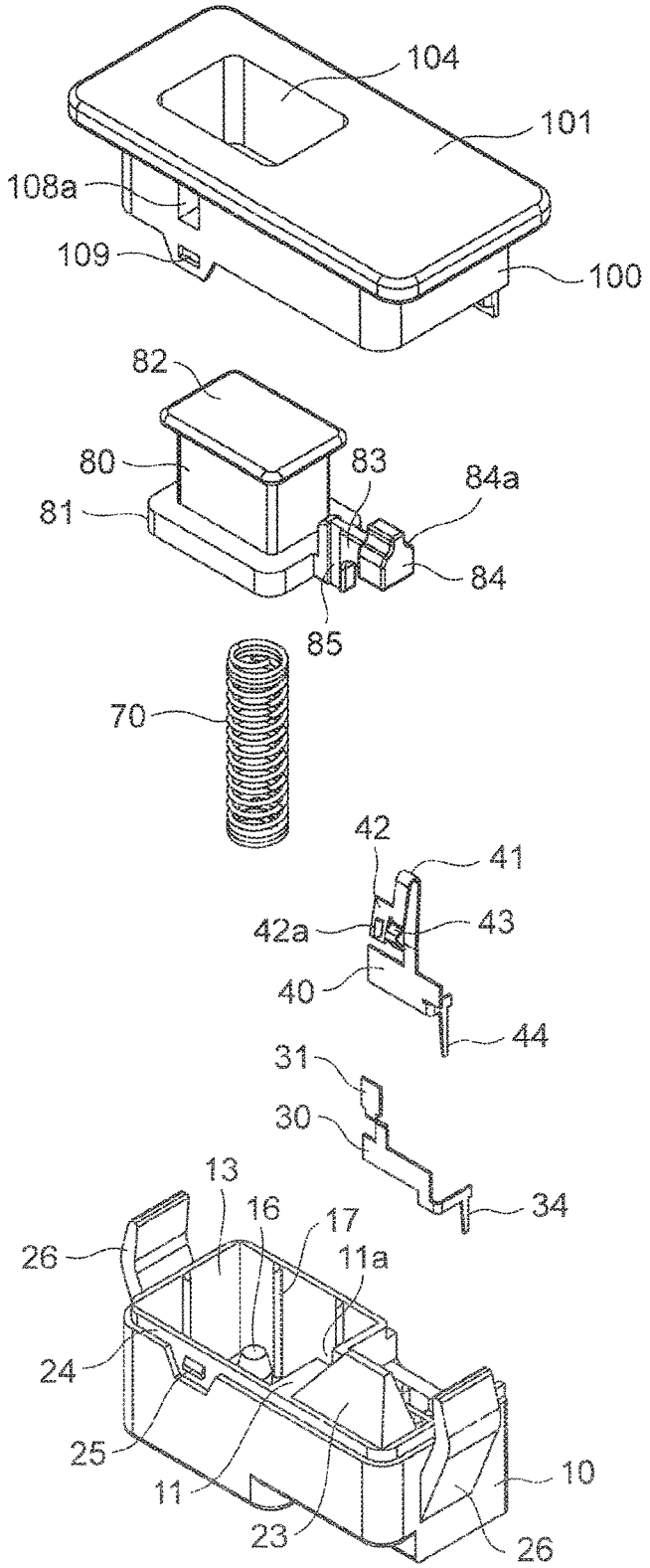
FIG. 43 is an exploded perspective view of the push button switch shown in FIG. 37.
Figure 44:
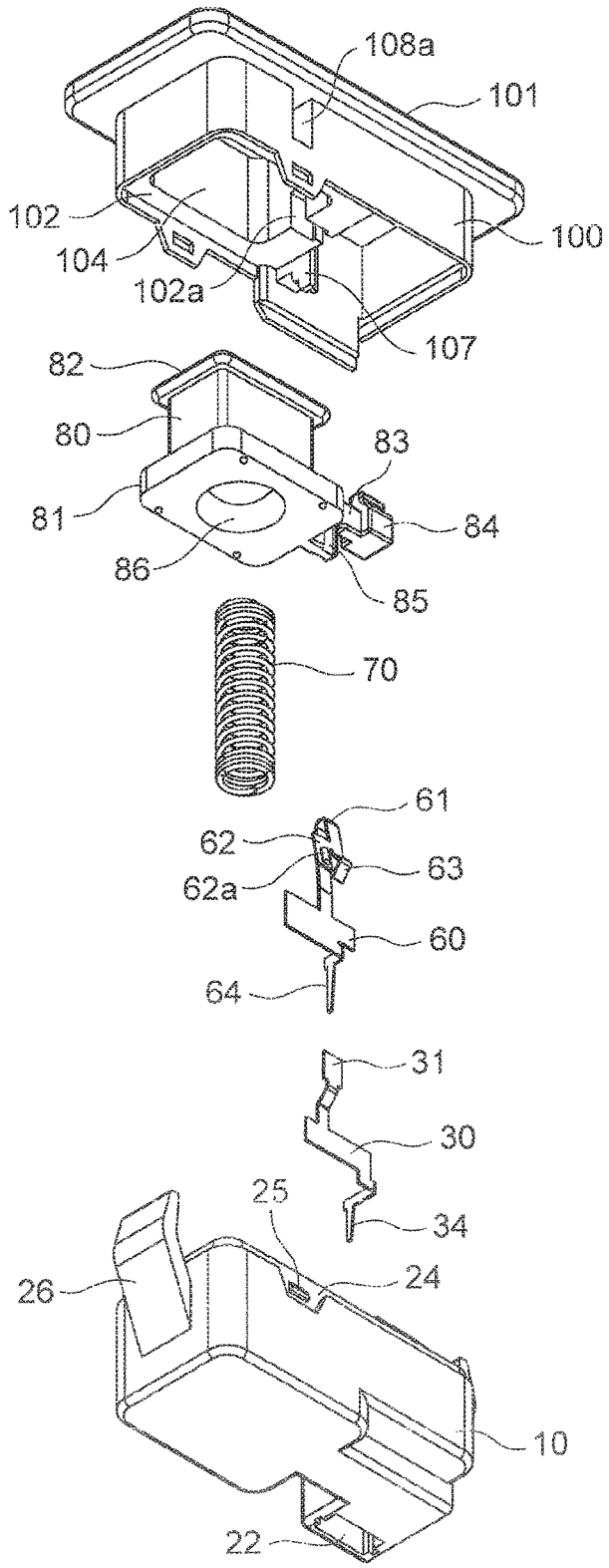
FIG. 44 is an exploded perspective view of the push button switch shown in FIG. 37, seen from a different angle.
Figure 45:
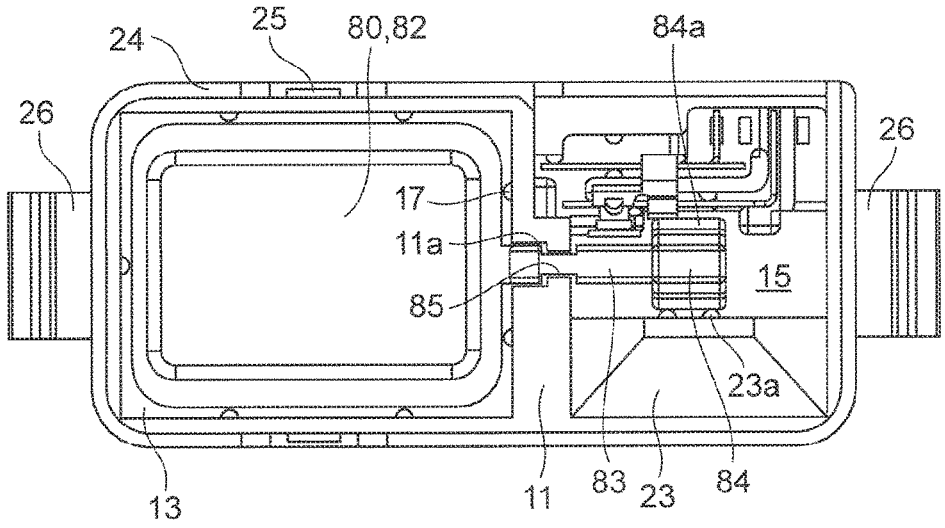
FIG. 45 is a plan view with a cover erased from the push button switch shown in FIG. 37.
Figure 46:
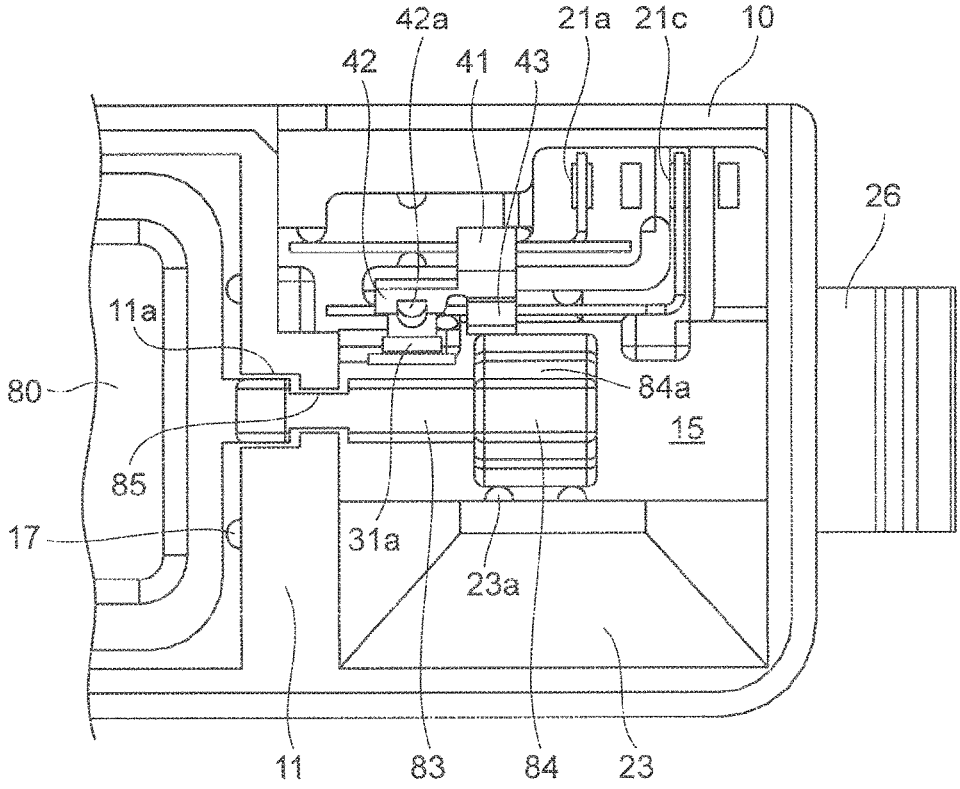
FIG. 46 is a partial enlarged view of FIG. 45.

As shown in FIGS. 43 and 44, the push button switch according to the present embodiment is roughly composed of a base 10, a common fixed contact terminal 30, a first movable contact terminal 40, a first return spring 70, a first plunger 80, and a cover 100. Since the basic structure is almost the same as that of the foregoing first embodiment, the same numerals are provided to the same portions and descriptions thereof are omitted.

Figure 37:
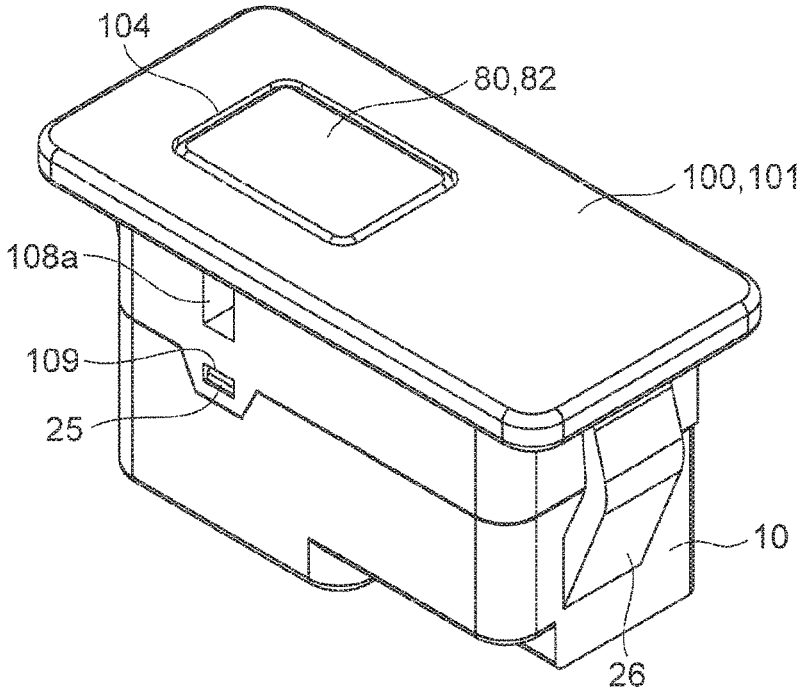
FIG. 37 is an overall perspective view showing a fourth embodiment of the push button switch according to the present invention.
Figure 38:
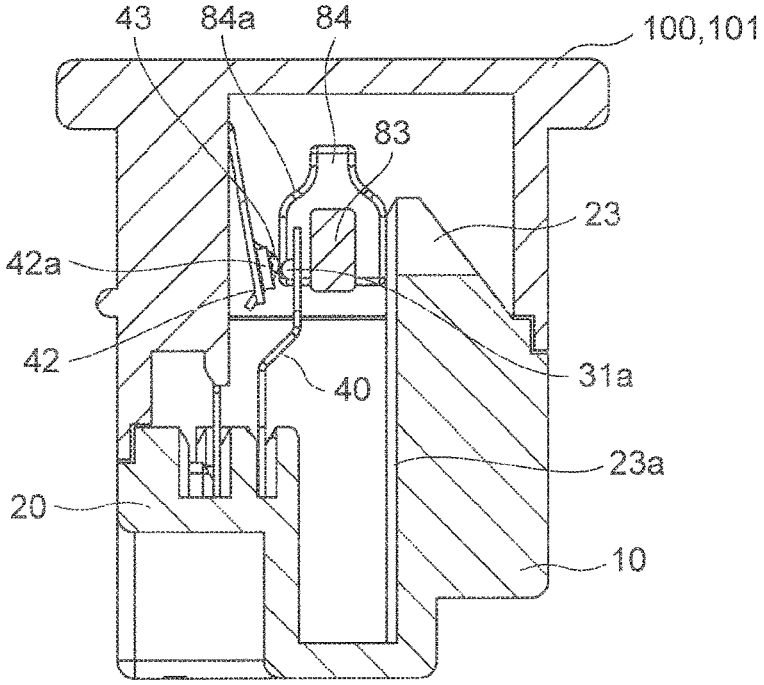
FIG. 38 is a front sectional view of FIG. 37.

As shown in FIGS. 37 and 38, the first plunger 80 is in a returned position before the operation, and hence the operation body 84 is pressing and contacting the operation tongue piece 43 of the first movable contact terminal 40, and the movable contact 42*a* is separated from the first fixed contact 31*a*.

Figure 39:
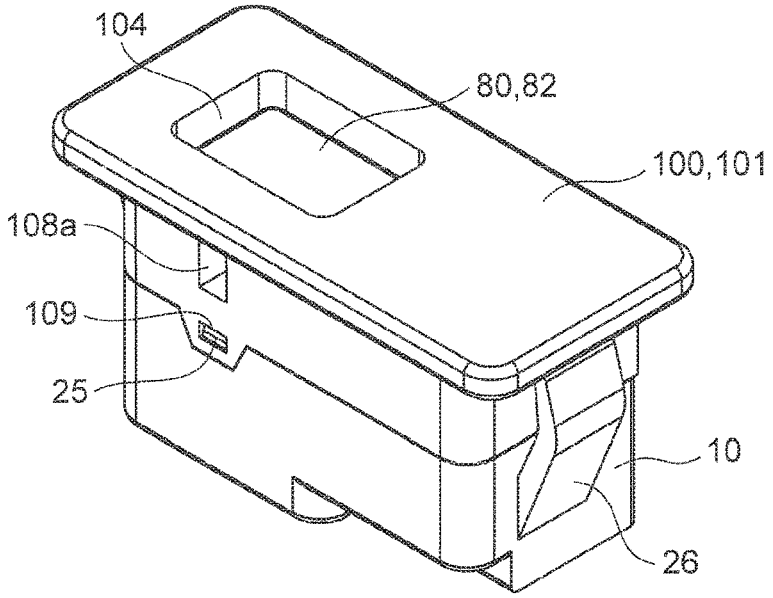
FIG. 39 is an overall perspective view showing the middle of operation of the push button switch shown in FIG. 37.
Figure 40:
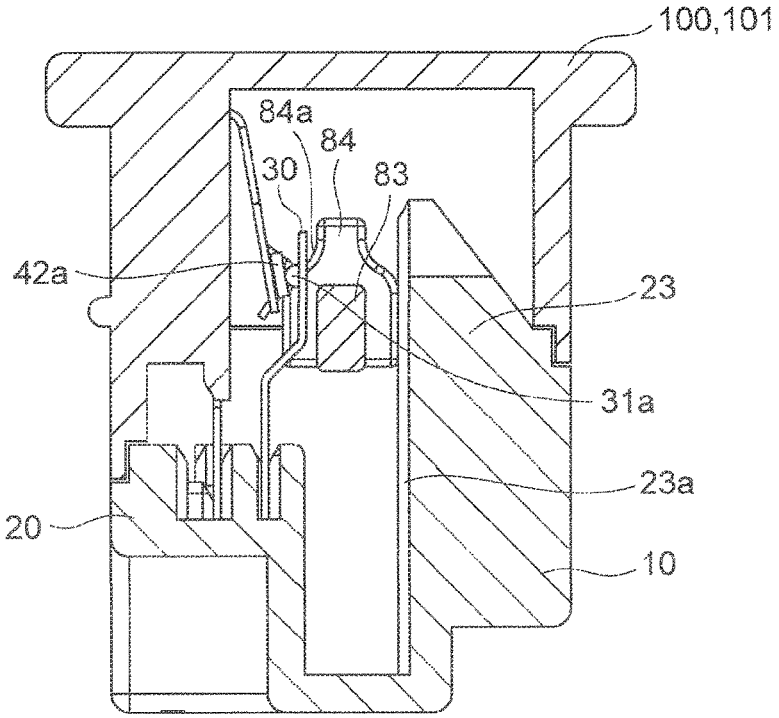
FIG. 40 is a front sectional view of FIG. 37.

Then, as shown in FIGS. 39 and 40, when the first plunger 80 is pushed down, the operation body 84 is lowered and the operation surface 84*a* slides on the surface of the operation tongue piece 43, to reduce a load on the operation tongue piece 43. Hence the movable contacting piece 41 is elastically returned, and the movable contact 42*a* comes into contact with the first fixed contact 31*a*.

Figure 41:
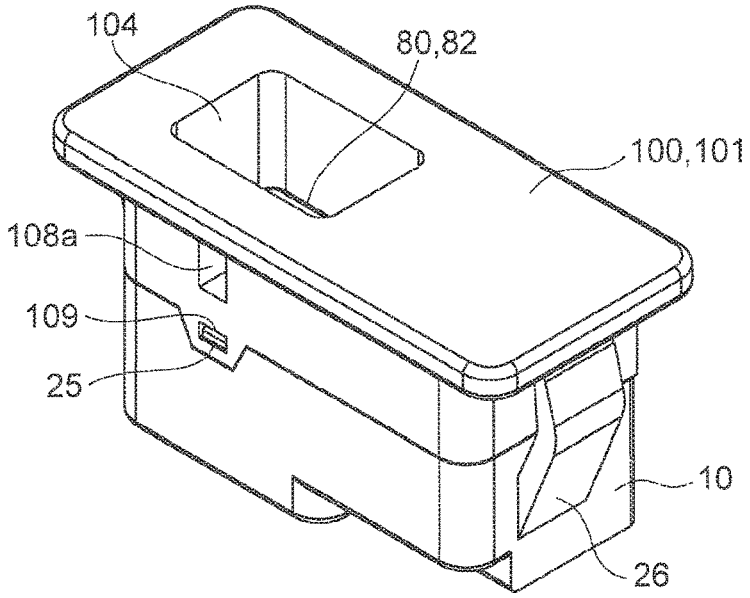
FIG. 41 is an overall perspective view showing a FIG. 37.
Figure 42:
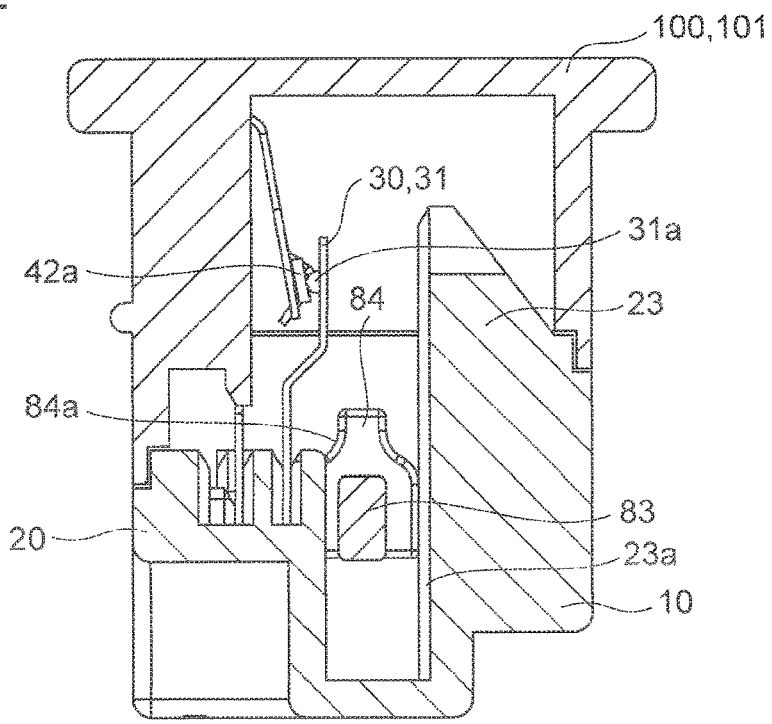
FIG. 42 is a front sectional view of FIG. 41.

As shown in FIGS. 41 and 42, when the first plunger 80 is further pushed down, the operation body 84 is lowered, and no load is then applied from the operation body 84. The movable contact 42*a* comes into contact with the first fixed contact 31*a* with predetermined pressure.

When the push-down operation on the first plunger 80 is released, the first plunger 80 is pushed back by the spring force of the first return spring 70, and returned to the original position. Hence the operation body 84 rises, the operation surface 84*a* pushes back the operation tongue piece 43, and the movable contact 42*a* is separated from the first fixed contact 31*a*.

According to the present embodiment, by selecting and combining common components as necessary, it is possible to obtain push button switches with different output types. There is thus an advantage that the number of components for manufacturing a larger variety of products is substantially reduced to facilitate inventory control for the components.

INDUSTRIAL APPLICABILITY

Needless to say that a push button switch according to the present invention is not limited to a refrigerator-freezer, but may be applied to other electric appliances and doors of buildings.

REFERENCE SIGNS LIST

10: base
11, 12: partition wall
11*a*, 12*a*: guide groove
13: first recess
14: second recess
15: third recess
16: support projection
17: positioning rib
18: support projection
20: step
21*a*, 21*b*, 21*c*, 21*d*: terminal hole
23: protrusion
30: common fixed contact terminal
31: first fixed contact piece
31*a*: first fixed contact
32: second fixed contact piece
32*a*: second fixed contact
33: third fixed contact piece
33*a*: third fixed contact
34: terminal portion
40: first movable contact terminal
41: movable contacting piece
42: movable contact piece
42*a*: movable contact
43: operation tongue piece
44: terminal portion
50: second movable contact terminal
51: movable contacting piece
52: movable contact piece
52*a*: movable contact
53: operation tongue piece
54: terminal portion
60: third movable contact terminal
61: movable contacting piece
62: movable contact piece
62*a*: movable contact
63, 64: operation tongue piece
65: terminal portion
70: first return spring
71: second return spring
80: first plunger
81: flange portion
82: pressing portion
83: operation arm portion
84: operation body
84*a*: operation surface
85: guide groove
86: housing hole
90: second plunger
91: flange portion
92: pressing portion
93: operation arm portion
94: operation body
94*a*: operation surface
95: guide groove
96: housing hole
100: cover
102, 103: annular partition wall
102*a*, 103*a*: guide groove
104, 105: operation hole
107: retaining rib
108*a*: drain hole
108*b*: drain hole
110: mounting plate
111: mounting hole

The invention claimed is:

1. A push button switch comprising:

a housing made up of a base and a cover;

a first plunger mounted on the cover so as to be pushed down, and having an operating arm portion projecting sideways from a surface of the first plunger and an operation body provided at a tip of the operating arm portion;

a movable contacting piece configured to be driven by a push-down operation on the first plunger;

a movable contact provided in the movable contacting piece; and a fixed contact disposed so as to come into and out of contact with the movable contact, wherein the movable contacting piece includes:

a movable contact piece provided with the movable contact, the movable contact piece being elastically deformable in a movement direction in which the movable contact is brought into and out of contact with the fixed contact; and a first operation tongue piece disposed on one of both sides of the movable contact piece so as to contact with the operation body, the first operation tongue piece being capable of elastically deforming integrally with the movable contact piece, wherein the operation body of the first plunger elastically deforms the first operation tongue piece in the movement direction by the push-down operation on the first plunger to bring the movable contact into and out of contact with the fixed contact.

2. The push button switch according to claim 1, wherein the operation body has an operation surface that slides on a surface of the first operation tongue piece.

3. The push button switch according to claim 1, wherein the movable contacting piece is bent in a substantially U-shape.

4. The push button switch according to claim 1, wherein the first operation tongue piece is bent so as to protrude toward the first plunger.

5. The push button switch according to claim 1, wherein a pressing portion of the first plunger is on a same plane as a surface of the housing.

6. The push button switch according to claim 1, wherein the movable contacting piece is configured as a single member.

7. The push button switch according to claim 1, wherein the push button switch comprises a second plunger mounted on the cover so as to be pushed down, and having an operating arm portion projecting sideways from a surface of the second plunger and an operation body provided at a tip of the operating arm portion of the second plunger, the movable contacting piece further includes a third operation tongue piece disposed on another side of the both sides of the movable contact piece so as to contact the operation body of the second plunger, the third operation tongue piece being capable of elastically deforming integrally with the movable contact piece, and the operation body of the second plunger elastically deforms the third operation tongue piece in the movement direction by the push-down operation on the second plunger to bring the movable contact into and out of contact with the fixed contact.

8. The push button switch according to claim 1, wherein the push button switch comprises a second plunger mounted on the cover so as to be pushed down, the second plunger having an operating arm portion projecting sideways from a surface of the second plunger and an operation body provided at a tip of the operating arm portion of the second plunger, the movable contacting piece includes a first movable contacting piece, a second movable contacting piece, and a third movable contacting piece, the first and second movable contacting pieces being symmetrically disposed in the housing, and the third movable contacting piece being disposed between the first and second movable contacting pieces, the first movable contacting piece has a first movable contact and the first operation tongue piece disposed on one of both sides of the movable contact piece, the second movable contacting piece is formed in a mirror-image relation with the first movable contacting piece, the mirror-image relation centered on an imaginary surface that separates the first movable contacting piece and the second movable contacting piece, the second movable contacting piece having a second movable contact piece provided with a second movable contact and a second operation tongue piece disposed so as to contact with the operation body of the second plunger, the second operation tongue piece being capable of elastically deforming integrally with the second movable contact piece, the third movable contacting piece includes a third movable contact piece provided with a third movable contact and a third operation tongue piece, the third operation tongue piece being disposed on another side of the both sides of the movable contact piece so as to contact the operation body of the second plunger and be capable of elastically deforming integrally with the third movable contact piece, and the fixed contact includes a first fixed contact, a second fixed contact, and a third fixed contact disposed so as to come into and out of contact respectively with the first movable contact, the second movable contact, and the third movable contact.

9. The push button switch according to claim 8, wherein the first and second plungers are formed in a mirror-image relation centered on an imaginary surface that separates the first and second plungers.

10. The push button switch according to claim 1, wherein the push button switch comprises a second plunger mounted on the cover so as to be pushed down, the second plunger having an operating arm portion projecting sideways from a surface of the second plunger and an operation body provided at a tip of the operating arm portion of the second plunger, the movable contacting pieces includes a first movable contacting piece and a second movable contacting piece which are disposed so as to be symmetrical in the housing, the first movable contacting piece has a first movable contact and the first operation tongue piece disposed on one of both sides of the movable contact piece, the second movable contacting piece is formed so as to have a mirror-image relation with the first movable contacting piece, the mirror-image relation centered on an imaginary surface that separates the first movable contacting piece and the second movable contacting piece, the second movable contacting piece having a second movable contact piece provided with a second movable contact and a second operation tongue piece disposed so as to contact with the operation body of the second plunger, the second operation tongue piece being capable of elastically deforming integrally with the second movable contact piece, the fixed contact includes first and second fixed contacts which are disposed so as to come into and out of contact with the first and second movable contacts, respectively, and the operation bodies of the first plunger and the second plunger elastically deform the first operation tongue piece of the first movable contacting piece and the second operation tongue piece of the second movable contacting piece respectively by the push-down operation on the first and second plungers in the movement direction to respectively bring the first movable contact of the first movable contacting piece and the second movable contact of the second movable contacting piece into and out of contact with the first fixed contact and the second fixed contact.

11. The push button switch according to claim 10, wherein the first and second plungers are formed in a mirror-image relation centered on an imaginary surface that separates the first and second plungers.

12. The push button switch according to claim 7, wherein the first and second plungers are formed in a mirror-image relation centered on an imaginary surface that separates the first and second plungers.

* * * * *